US010002600B1

(12) United States Patent
Owens

(10) Patent No.: US 10,002,600 B1
(45) Date of Patent: Jun. 19, 2018

(54) GESTURE PAD AND INTEGRATED TRANSDUCER-PROCESSOR UNIT FOR USE WITH STRINGED INSTRUMENT

(71) Applicant: Duane G. Owens, Kiowa, CO (US)

(72) Inventor: Duane G. Owens, Kiowa, CO (US)

( * ) Notice: Subject to any disclaimer, the term of this patent is extended or adjusted under 35 U.S.C. 154(b) by 0 days. days.

(21) Appl. No.: 15/726,640

(22) Filed: Oct. 6, 2017

Related U.S. Application Data

(62) Division of application No. 14/216,865, filed on Mar. 17, 2014, now Pat. No. 9,799,316.

(60) Provisional application No. 61/801,762, filed on Mar. 15, 2013.

(51) Int. Cl.

| | |
|---|---|
| ***G10H 3/18*** | (2006.01) |
| ***G10H 3/22*** | (2006.01) |
| ***G10H 1/32*** | (2006.01) |
| ***G10H 1/02*** | (2006.01) |

(52) U.S. Cl.
CPC ..... *G10H 3/22* (2013.01); *G10H 1/02* (2013.01); *G10H 1/32* (2013.01); *G10H 2210/195* (2013.01); *G10H 2220/165* (2013.01); *G10H 2220/401* (2013.01); *G10H 2220/465* (2013.01)

(58) Field of Classification Search
CPC .. G10H 3/22; G10H 1/02; G10H 1/32; G10H 2210/195; G10H 2220/165; G10H 2220/401; G10H 2220/465
USPC ..... 84/726
See application file for complete search history.

(56) References Cited

U.S. PATENT DOCUMENTS

| | | | | |
|---|---|---|---|---|
| 5,637,823 | A * | 6/1997 | Dodge | G10H 1/32 84/726 |
| 5,854,437 | A * | 12/1998 | Merrick | G10G 7/02 84/454 |
| 5,986,201 | A * | 11/1999 | Starr | G10H 1/0066 84/464 A |
| 6,043,422 | A * | 3/2000 | Chapman | G10H 1/32 84/723 |
| 6,800,800 | B1 * | 10/2004 | Giordano | G10H 1/32 84/453 |
| 7,838,758 | B2 * | 11/2010 | Van Ekstrom | G10H 3/183 84/726 |
| 7,956,847 | B2 * | 6/2011 | Christie | G06F 3/044 345/173 |
| 8,093,482 | B1 * | 1/2012 | Kramer | A63J 17/00 84/464 A |

(Continued)

*Primary Examiner* — Jeffrey Donels
(74) *Attorney, Agent, or Firm* — Colorado Patents

(57) ABSTRACT

An integrated transducer-processor unit for use with a stringed instrument having one or more strings. When the instrument is played, the unit produces electrical output signals for conversion into musical sounds. A transducer converts mechanical vibrations of each of the strings into corresponding electrical signals, and a processor processes the electrical signals to produce selected analog or digital output signals for conversion into musical sounds. The unit processor is integrated with the transducer into a pickup, for mounting on the instrument in proximity to the strings without modification of the instrument. In addition, a gesture pad-processor system provides an interface for a user to send control signals to a device to control at least one function of the device. A touch pad receives positional and pressure inputs entered by the user making a selected predefined manual gesture for conversion into a control signal by the system processor.

20 Claims, 7 Drawing Sheets

(56) References Cited

U.S. PATENT DOCUMENTS 8,269,095 B1 * 9/2012 Wallace ..... G10H 3/143 84/726
8,686,952 B2 * 4/2014 Burrough ..... G06F 3/016 345/156
8,809,665 B2 * 8/2014 Patterson ..... G06F 3/04883 84/615
9,000,287 B1 * 4/2015 Andersen ..... G10H 1/32 84/622
9,799,316 B1 * 10/2017 Owens ..... G10H 3/22
2004/0252486 A1 * 12/2004 Krause ..... A63J 17/00 362/85
2006/0156913 A1 * 7/2006 Fishman ..... G10H 1/32 84/743
2007/0131100 A1 * 6/2007 Daniel ..... G10H 1/053 84/737
2009/0072765 A1 * 3/2009 DeBock ..... H05B 33/0863 315/325
2011/0088535 A1 * 4/2011 Zarimis ..... G10H 1/0066 84/645
2013/0255474 A1 * 10/2013 Hanks ..... G10H 1/342 84/615
2013/0263721 A1 * 10/2013 Shavit ..... G10H 1/055 84/626
2013/0290818 A1 * 10/2013 Arrasvuori ..... H04N 21/4383 715/201
2014/0060289 A1 * 3/2014 Hirshberg ..... G10H 5/00 84/654
2015/0040744 A1 * 2/2015 Redding ..... G10H 3/18 84/726
2015/0068392 A1 * 3/2015 Huston ..... G10H 3/181 84/726
2015/0199949 A1 * 7/2015 Fishman ..... G10H 3/143 84/726
2015/0278137 A1 * 10/2015 Gan ..... G06F 13/387 710/11
2015/0332660 A1 * 11/2015 Adams ..... G10H 1/0066 84/645

* cited by examiner

GESTURE PAD AND INTEGRATED TRANSDUCER-PROCESSOR UNIT FOR USE WITH STRINGED INSTRUMENT

CROSS REFERENCE TO RELATED APPLICATIONS

This application is a divisional application of application Ser. No. 14/216,865, filed Mar. 17, 2014 which, in turn, is a nonprovisional application claiming the benefit under 35 USC 119(e) of U.S. provisional application Ser. No. 61/801,762, filed on Mar. 15, 2013.

TECHNICAL FIELD

This invention relates to pickups for use with an electric guitar in converting string vibrations to an electrical signal, and more particularly to an intelligent pickup having a processor for altering the signals produced by the pickup; and further relates to a control interface capable of use with the pickup, and having a sensor pad for receiving and recognizing XYZ inputs from a user.

BACKGROUND OF THE INVENTION

Electric stringed instruments have long been known in the music field. By far the most commonly known and used of these instruments is the electric guitar, which has been around since the 1930's.

The signal from an electric guitar originates as mechanical vibrations caused by the musician playing the strings of the instrument. In a conventional electric guitar, these mechanical vibrations are picked up by an electro-mechanical transducer, known as a "pickup," located on the body of the guitar near the strings. The traditional pickup has several magnetic poles, each of which is positioned in close proximity to a respective string of the guitar. The poles are encircled by a conductive wire coil or coils, such that when the strings vibrate, the magnetic field of the poles is disturbed and an electrical signal is generated through the coil(s). In this way, the pickup converts an input in the form of mechanical vibrations into an output in the form of an electrical signal; hence the description of the pickup as "electro-mechanical."

The electrical signal created by the pickup may then be processed to create desired musical attributes called "effects, " e.g., pitch, volume, or tone. This processing is typically done by a variety of equipment, such as amplifiers, foot pedals, or other equipment designed for creating such effects. After any desired effects have been produced, the signal is ultimately sent through speakers where it is converted into musical sounds. Traditional pickups are thus passive devices whose sole purpose is to convert mechanical energy into electrical energy, with any changes to the electrical signal created by the pickup being made extraneously to the pickup.

Traditional pickups may be divided into two broad categories: (1) single-coil pickups; and (2) divided pickups. Both types of pickups have several magnetic poles, with each pole being paired in close proximity to a respective string of the instrument. However, single-coil pickups have only one wire coil, which encircles all of the pickup's magnetic poles as a group. Therefore, single-coil pickups produce only one electrical signal, that signal representing the aggregate of all the musical notes generated by all of the strings taken together.

Single-coil pickups are typically contained in a housing which fits neatly into any one of several cavities commonly provided on traditional electric guitars, specifically for pickups. In fact, almost all traditional electric guitars are designed to accommodate single-coil pickups in this way. In addition to fitting neatly into the traditional cavities, replacement pickups are generally sold with wiring designed to match wiring which is also commonly provided in those cavities. It is thus very convenient—and also quite common—for users to replace the factory pickups on their guitars with single-coil pickups of their own choosing, typically installing the pickups in one of the aforementioned traditional cavities. Such retrofitting allows guitar users to easily achieve desired musical qualities, which may vary from pickup to pickup.

A sub-class of single coil pickups does exist, called "Humbuckers." Humbuckers are simply a variation of a single-coil pickup; except that instead of having the typical single coil, a Humbucker has a pair of single coils wired so as to produce signals which are opposite in phase, thereby cancelling out some "hum" inherent in single-coil pickups. For practical purposes of this discussion, Humbuckers are treated as single-coil pickups.

Many electric guitars have one or more pickups, some as many as three pickups. Generally, these multi-pickup instruments have the pickups located at specific places on the instrument to provide a variety of tonal qualities. For example, a pickup located in the cavity closest to the bridge of the instrument produces a tone in which higher frequencies are accentuated, while a pickup located in a cavity further from the bridge will produce a tone in which lower frequencies are more accentuated. A simple selector switch is generally used to select between the pickups on the instrument. Some pickups are highly prized for their tonal qualities, and there are many after-market manufacturers who produce pickups that can be easily installed by the user. It is very common for a user to replace the factory pickups on their instrument in order to achieve a desired tone.

Another, less commonly used type of pickup is called a "divided" pickup. As is true in a traditional single-coil pickup, a traditional divided pickup has a magnetic pole for each string of the instrument, with each pole being in close proximity to that respective string of the instrument. However, in contrast to the poles of single-coil pickups, each pole of the divided pickup is wrapped individually with its own coil. Such individual wrapping of each pole results in a separate electrical signal being produced for each string of the instrument. This is highly advantageous, as it affords the user the potential to modify or affect the signal from each string individually in unique ways, as opposed to processing only the aggregate signal produced by the single-coil pickup.

For example, one way of modifying the signal from each string is by altering its pitch, thereby allowing the user to create an infinite variety of harmonic and transposed musical forms. Secondly, the volume or signal level of each string can be modified independently, which allows the user to create interesting mixes such as muting certain strings or accentuating one or more strings to bring out each string's unique character. Still another capability is that of independently modifying the tone of each string, thereby allowing the user to accentuate or minimize certain frequencies of the strings. These effects could also be used to correct flaws in the sound of the strings; for example, correcting the pitch of an out-of-tune string, or raising the volume of a string that is too soft. The foregoing are just a sampling of the kinds of effects—and therefore benefits—which are made possible by using a divided pickup rather than a single coil pickup.

However, precisely because they produce multiple individual signals rather than a single aggregate signal, traditional divided pickups suffer certain significant drawbacks. For instance, if the poles and coils of the divided pickup were to be as large as those of a traditional single-coil pickup, the resulting electrical signals would be so strong as to produce cross-talk interference between the respective signals. The problem cannot be solved by increasing the distance between poles, as that would make it impossible to retain the necessary proximity of each pole to its associated string.

This cross-talk problem has commonly been solved by utilizing much smaller poles and coils, and then adding onboard pre-amplifiers to boost the resulting weaker signals, so that the signals may travel the significant distance to off-board equipment without unacceptable signal attenuation or signal interference. However, these pre-amplifiers are often bulky, and are generally aesthetically un-pleasing. Further, because the divided pickup produces a separate signal for each string, a bulky multi-pin cable is also required to effectively send the multiple signals off-board.

In addition, since traditional off-board amplifiers, speakers, foot pedals and the like are designed to operate off of a single analog signal, specialized equipment is required off-board to handle the multiple-signal output of this configuration. Traditionally, two distinct solutions have been implemented to handle this issue. One solution has been for all of the amplifiers, speakers, and other off-board equipment to be specially designed to operate off of multiple signals from a multi-pin cable. The other solution has been to provide a converter box to receive the signals from the multi-pin cable, and to convert them into a single signal compatible with traditional equipment. Both solutions have been workable; but as noted, each solution inconveniently requires additional specialized equipment.

The foregoing drawbacks of the traditional divided pickup have resulted in it being much less popular than the traditional single-coil pickup. This is unfortunate, since the divided pickup is vastly superior to the single-coil pickup in its capability of processing the sound of each string individually, as discussed above. Yet due to all of the aforementioned added components, the use of a traditional divided pickup has been inconvenient and aesthetically unappealing, as well as expensive.

In more recent years, microprocessors have been increasingly utilized to modify the electrical output signal emanating from an electric guitar, to create desired effects. These powerful microprocessors can perform complex calculations and conversions at the high speeds required for real-time pitch changes and multi-part harmony effects, for example. In particular, the power and decreasing size of microprocessors has made it feasible to take advantage of the divided pickup's potential for individually modifying the sounds from each string, through a wide variety of designs which would otherwise simply be impractical.

From the instrument perspective, all of these designs utilizing microprocessors may conveniently be divided into two distinct types: (1) onboard configurations, in which most of the processing elements are placed on the guitar itself; and (2) off-board configurations, in which the processing elements are located elsewhere than on the guitar. Space is not a concern with off-board configurations, nor are the aesthetics of large numbers of buttons and dials used to control the processing. However, it does remain desirable in the off-board environment that control be intuitive and not overwhelming in complexity. By contrast, in the onboard configurations, space, aesthetics, and straightforward and intuitive control are all constraints of paramount importance. Notably, the traditional approach in placing processing and controls onboard has essentially been merely to move all of the off-board processing and controls onto a customized instrument. Unfortunately, in practice this approach does not favor considerations of space, aesthetics, or straightforward and intuitive control, as discussed below.

An example of the onboard approach may be found in U.S. Pat. No. 5,308,916 to Murata. Murata illustrates an entirely self-contained customized instrument, in which all processing and control is located on the instrument, even including the speakers. This configuration utilizes more than thirty switches or buttons, which are located in three separate locations on the instrument. The large number of buttons and switches certainly provides the user with a great deal of control options; however, there are disadvantages to using so many buttons and switches. For one, the instrument is cluttered with all the controls, which is aesthetically unpleasing. In addition, the very large array of buttons and switches is potentially overwhelming to the user, who may find it difficult and distracting to keep so many options straight in his mind, while still maintaining a spontaneity in his performance. Furthermore, the electronics required to implement this approach are quite bulky, due to the inclusion of so many components in a single instrument. Along those same lines, by their very nature customized guitars are typically designed with no potential for retrofitting components into the guitar. Such instruments are thus expensive to purchase, cumbersome to use, and also difficult for the average user to alter or maintain.

U.S. Pat. No. 6,111,184 to Cloud also utilizes an onboard approach, in which processing and control elements are located onboard the guitar, although Cloud does not place the speakers onboard. The Cloud design provides an onboard processor, as well as four or five buttons or switches to control the onboard processing. By utilizing a small number of controls as compared to Murata, the Cloud approach avoids some of the aforementioned problems of aesthetics and clutter associated with having a large number of controls on the instrument. However, by severely limiting the number of onboard controls, the Cloud approach also greatly restricts user control capabilities as compared to the instrument of Murata.

In addition, Cloud also provides a series of customized pickups having corresponding custom pickup cradles, which together allow the pickups to be upgraded as desired. However, these customized pickups are not interchangeable with conventional pickups. The custom cradles are designed for the custom guitar of Cloud, and would be difficult if not impossible for the average user to install, either on the custom guitar of Cloud or on a traditional guitar. This is a shortcoming of both the Cloud and Murata designs, as it is customary for users to often replace and/or upgrade their pickups with pickups of their own choosing. The pickup and the processor of Cloud are also separated from one another by some distance, which requires wiring to connect the two. At least one wire is required for each string of the instrument, making the wiring complicated and aesthetically unpleasing. This added wiring also brings with it the potential for damage to exposed wires. In addition, extending wiring between the processor and the pickup raises the potential problem of cross-talk and interference occurring in the wires. These problems become worse as the distance between the pickup and the processor increases, due to the increased potential for interference, plus the signal amplification required to send the signal over the length of the wires without undue attenuation. These problems of cross-talk and interference may require special shielding to prevent, or specialized circuitry to filter the resulting noise from the signal.

A commercially marketed custom guitar similar to Cloud and Murata designs described above was designed by the Roland Corporation, and marketed for a time by the Fender Musical Instruments Corporation. The Roland design incorporated many of the electronics from their external foot-pedal-activated effects unit which required a special 13-pin cable to interface the effects unit with a specialized pickup installed on the guitar. Incorporating those electronics into the body of the guitar allowed Roland to process the multiple signals onboard, and to then re-mix them into a single signal to be sent off-board. In this way, Roland was able to avoid the usual requirement for a specialized multi-pin cable to carry multiple signals to off-board equipment. Because of space and design limitations, control of these electronics was limited to very simple controls, utilizing just selector knobs. The use of such simple controls severely limited user control choices, and provided limited ability for dynamic user expression. In addition, it was not easily upgradeable and was expensive. For these reasons, among others, it was not commercially successful, and was ultimately withdrawn from the market.

In addition to the shortcomings discussed above, the all-in-one approach exemplified by Murata, Cloud, and Roland suffers from other potential drawbacks. There are many widely-used off-board effects processors designed specifically to create particular effects such as reverb, delay, distortion, and amplifier/speaker simulation. Often these dedicated effects processors are quite efficient at their specialized purpose, and have unique qualities which are highly prized by musicians. Attempts by the onboard all-in-one approaches to replace these popular off-board processors with specialized proprietary processors have met with only partial success. For one thing, matching the efficient and unique performance of the off-board dedicated effects processors may require large amounts of processing power to be placed onboard the instrument, typically with a corresponding increase in control knobs and switches. Even then, it is far from certain that the desired effects will be produced as well as they would be with the dedicated off-board equipment. For these reasons, it may be disadvantageous for the musician to replace his highly prized off-board effects processors with an onboard all-in-one design.

There is thus a need for processor-driven hardware for stringed instruments which provides easily used processing and intuitive control onboard the instrument. Ideally, the processor-driven hardware would be well suited for retrofitting by the typical user into existing space(s) on the instrument, with little or no modification of the instrument itself, and with no special wiring or other installation skills required of the user. The hardware would have sufficient processing capability to provide a greatly enhanced range of effects, while still being physically unobtrusive so as to maintain the aesthetics of the instrument. The hardware would allow the user to employ a divided pickup, in order to take advantage of the capability of processing the sound from each string of the instrument, without requiring additional equipment to handle a multi-signal output generated by the divided pickup.

The custom guitars presented by Murata, Cloud and Roland also illustrate other limitations found in those designs, particularly in the musician-processor interfaces utilized in the guitars. All of those custom guitars provide buttons and switches by which the musician controls effects processing to be performed in playing the instrument. However, all of those buttons and switches are directed solely toward effects processing to be performed onboard the instrument; no attempt is made to control effects processing off-board the instrument. In Addition, while buttons and switches may accomplish their intended purpose, they are clumsy, and create clutter on the instrument and potential confusion for the musician.

There are also interface devices available in the general field of computer interface technology which are more efficient and versatile than the traditional buttons and switches. Instead of toggling on-off, or operating on a fixed scale as with traditional buttons and switches, these interfaces provide a broader range of options for input values. Such computer interface devices include the well-known keyboard, mouse, and touch pad, and variations thereon.

Keyboards are well understood and are useful for entering specific data values or for navigating menus. However, keyboards require too many keys and too much space to operate, and are thus unsuited for use on musical instruments. Mice and touch pads are particularly useful for navigating, selecting, and drawing; however, because they are peripherals dependent on a host device and designed specifically to work with graphical images, they generally require a computer environment which includes a monitor screen. This not only severely limits the types of devices with which mice and touch pads can work, but also requires the visual attention of the user in order to operate them.

Moreover, traditional touch pads such as those found on notebook computers are two-dimensional positioning devices, with no ability to sense pressure. Therefore, any "gesturing" with a touch pad is necessarily limited in scope. Such touch pads are also typically programmed only for cursor movement, plus drag, drop and click actions using buttons typically provided with touch pads. This is because the traditional touch pad is directed exclusively toward use in a windows environment (as used herein, "windows environment" refers to any software that provides multiple windows for documents or pictures on screen), and is generally intended merely as a mouse replacement. Finally, traditional touch pads do not accept multiple finger positions, as required for "pinching" or "flicking" actions.

Various attempts have been made to improve upon the traditional touch pad. U.S. Pat. No. 6,028,071 to Gillespie provides an enhanced touch pad, which has all the features of a conventional touch pad, and further includes Z-sensitivity (pressure sensitivity). The touch pad of Gillespie is thus similar to the touch screen of an I-pad. It allows the user to "flick" the screen to turn pages, and to "pinch" together items on the screen to reduce their size. However, like a traditional touch pad, the Gillespie touch pad is directed toward use with graphical images in a conventional windows environment, as found in general computing applications. Gillespie thus requires a monitor screen, which once again limits the user's options, and further requires the user's visual attention. Gillespie does mention a capability for "gestures;" however, his device seeks to act more as an enhanced replacement for a standard touch pad/mouse combination peripheral, with any built-in "gestures" being limited to the standard point, drag, drop and click actions, plus the "flick" and "pinch" actions described above. Nor is there any provision made for programming additional gestures into the device. Therefore, the Gillespie device would be of little use in a musical performance environment.

U.S. Pat. No. 7,656,394 and U.S. Patent Application Number 2006/0238520 A1 to Westerman provide a touch pad having all the features found in the Gillespie touch pad, and additionally provide a "soft" keyboard and a "soft" mouse. The touch pad of Westerman is thus entirely directed toward replacing all of the peripheral interface devices found in conventional computing—the keyboard, mouse, and touch pad. While this is clearly an enhanced interface device, it is nonetheless directed exclusively toward a windows environment, with all the aforementioned limitations associated with that environment, including the limited range of "gestures" typically found in that environment. Westerman's device would thus have little or no application as an onboard interface on a musical instrument, nor for any use other than as a peripheral device in a windows environment.

Modern tablet computers and some mobile phones have incorporated multi-touch screens which include pressure (Z-) sensitivity. These screens allow the user to employ simple "gestures" consisting of finger-tip position and pressure on a sensor surface which are interpreted as input values. When thus performed on the sensor surface of the screen, these simple gestures serve the limited purpose of navigating through the menus and displays of their respective devices. Unfortunately, those devices have yet to be successfully adapted for use onboard musical instruments. Clearly, the size, expense, and complexity of a tablet computer or other device renders them impractical for such onboard use. In addition, the devices require the user to continually refer to the display in order to operate the device, which is simply not feasible in a musical performance environment. Furthermore, the interfaces themselves are built into the tablet computer or other device, and are not capable of standing alone. The touch screen also has no intelligence of its own, and is thus not capable of being programmed to respond to user-created gestures.

U.S. Patent Application Number 2010/0020025A1 to LeMort provides a method for multiple users to collaborate using continuous multi-touch gestures. Typical uses of the LeMort method would include collaboration among users on games or business applications. While LeMort does provide continuous, multi-touch gesturing and multi-user collaboration, his method is directed primarily toward replacing traditional mouse/keyboard peripheral inputs. Its applicability to musical instruments is limited because it requires the use of a graphical display to provide visual feedback. Such a graphical display is poorly suited for use on musical instruments, in particular because a performer is typically unable to view the graphical display while performing. Finally, LeMort does not address the use of pressure as a multi-touch gesture element; thereby limiting the range of musical expression.

There is thus a need for an interface device suitable for a musician to control a microprocessor in use with a musical instrument. The interface would ideally be simple and unobtrusive, so as to avoid clutter and other aesthetic problems when used onboard the instrument. The device would be intuitive and easily used, and ideally gesture-driven, so as to avoid confusion in the rapidly paced environment common to musical performances. The device would preferably be programmable, either by the user, the vendor, or both to recognize intuitive gestures and associate them with selected commands. It would thus allow the user to use gestures which were intuitive in a musical environment, as well as for the user himself Ideally, the musician would be able to easily perform these intuitive gestures by "feel," without the necessity of looking at the device in order to properly input the gesture. The device would also be suitable for off-board use, and would be capable of controlling and collaborating with other users, devices or equipment in addition to musical instruments.

SUMMARY OF THE INVENTION

In accordance with the present invention, an integrated transducer-processor unit for use with a stringed instrument having one or more strings is provided. When the instrument is played, the unit produces electrical output signals for conversion into musical sounds. The integrated transducer-processor unit includes a transducer for converting mechanical vibrations of each of the strings into corresponding electrical signals. A processor is also provided for processing the electrical signals from the transducer to produce selected analog or digital output signals for conversion into musical sounds. The unit has communication electronics for sending the output signals off-board from the unit. The unit processor is integrated with the transducer into a pickup, for mounting on the instrument in proximity to the strings, without modification of the instrument. For best results, the pickup is configured to be mounted underneath the strings.

The unit preferably also includes a user interface for controlling the processor to alter the output signals, with the user interface having communication electronics for sending signals off-board from the interface. Advantageously, the unit communication electronics is further capable of receiving signals from off-board the unit. Ideally, the unit processor is capable of generating control signals from the electrical signals produced by the transducer, with those control signals being capable of being used to further direct the processing of the electrical signals in order to produce selected musical effects in the output signals, or to control an external device, or both.

The invention also provides a gesture pad-processor system for use as an interface by a user to send control signals to at least one device to control at least one function of that device. The gesture pad-processor system includes a gesture pad having a body with a touch pad thereon for receiving positional and pressure inputs entered by the user making a selected predefined manual gesture with at least one digit on the surface of the touch pad. The touch pad includes a transducer for converting the selected manual gesture inputs into electrical signals constituting a data set defining the selected manual gesture, where the data set consists of x and y values representing position and z values representing pressure.

A processor having an array of stored data sets representing predefined manual gestures is included, with each of the stored data sets having a control signal associated therewith. In practice, when a manual gesture is selected from the array of predefined gestures and is entered into the pad and converted to an x, y, z data set, the processor compares the entered x, y, and z data to the array of stored data sets of predefined manual gestures, and if a stored data set is found in the array which matches the entered x, y, z data, the processor sends the control signal associated with the matching stored data set to the device to control at least one function of the device.

The system also includes communication electronics, for use by the system to send the electrical signals, the control signals, or both to the device. Both the gesture pad and the device utilize a communication protocol which allows for sending the electrical signals, the control signals, or both to the device to control the operation of the device. Advantageously, feedback is provided to the user from touching the gesture pad while making the selected predefined manual gesture, and from the operation of the device, without the use of a graphical user interface, to enable the user to determine the extent to which the device function has been controlled as desired.

In view of the foregoing, several advantages of the present invention are readily apparent. An integrated transducer-processor unit is provided which is capable of being housed in a pickup, and of being retrofitted to many existing musical instruments without the need for modification of the instrument. The unit has processing capability, which allows it to easily and efficiently produce a much wider range of musical effects and sounds than may be produced with the typical pickup. Because it may be contained in roughly the same housing as a conventional pickup, the unit does not sacrifice the aesthetics of the instrument to produce the greatly enhanced musical results which are available with the use of the unit.

The gesture pad-processor system of the invention allows the user to use intuitive gestures to control a multitude of devices, without the need for a graphical user interface. The gesture pad-processor system is particularly well-suited for use in a musical performance environment, where intuitive gestures allow the user to control one or more functions of a device, primarily by tactile and audible feedback.

Additional advantages of this invention will become apparent from the description which follows, taken in conjunction with the accompanying drawings.

DETAILED DESCRIPTION OF PREFERRED EMBODIMENTS

Figure 1:
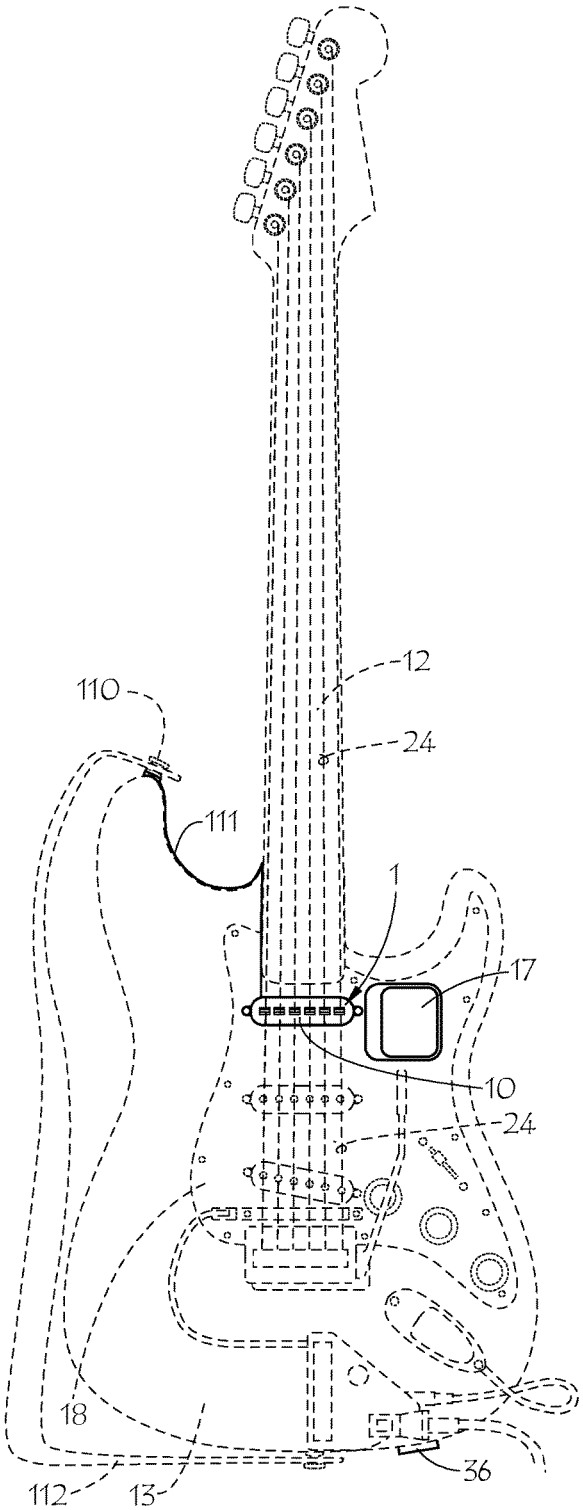
FIG. 1 is a front view of a guitar, with the intelligent pickup system in place thereon.
Figure 2:
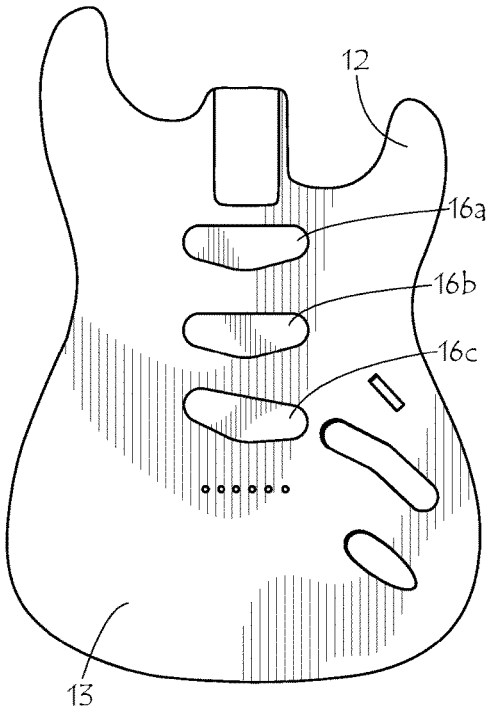
FIG. 2 is a front view of the body of a typical guitar, showing the location of pickup receptacles.
Figure 3:
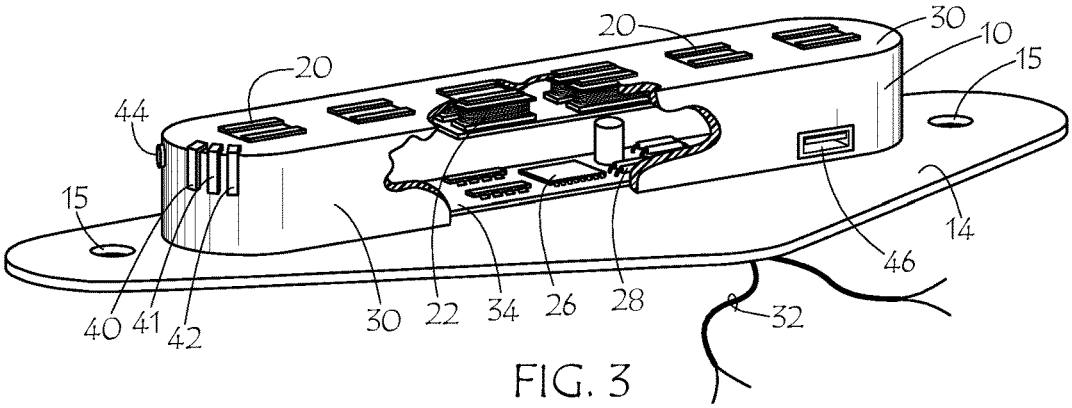
FIG. 3 is a perspective view of the intelligent pickup, with a partial cutaway showing the inner electronics and processor.

Referring to FIGS. 1-3, intelligent pickup system 1 is shown in place on a guitar 12. The intelligent pickup system 1 includes an integrated transducer-processor unit 10 (called the "intelligent pickup," to denote the combination of a traditional pickup with a microprocessor or other processor to alter the output of the transducer and ultimately create musical effects) which is preferably mounted in one of the receptacles 16*a,b*, or *c* located on the front 13 of the guitar 12, typically by use of mounting base 14 having mounting holes 15. For illustration purposes, the intelligent pickup 10 is mounted in receptacle 16*a*, although receptacles 16*b* or 16*c* are equally well-suited for receiving the intelligent pickup 10. The receptacles 16*a*, 16*b*, and 16*c* are shown in locations which are traditional pickup locations on most guitars; i.e., in the neck, bridge, or center positions of the instrument. Other locations are feasible, but those three locations have traditionally been preferred by musicians for their respective tonal qualities. In this embodiment, with the intelligent pickup 10 mounted in receptacle 16*a*, receptacles 16*b* and 16*c* are available for traditional pickups at the musician's option. Some traditional pickups—especially early vintage models—are highly desired by musicians for their unique sound qualities. While the intelligent pickup will preferably be able to emulate those unique sound qualities, the use of traditional pickups in conjunction with the intelligent pickup remains a matter of personal preference for the musician. Use of traditional pickups in conjunction with the intelligent pickup also gives the musician maximum flexibility in his choice of technologies, allowing him to select the mix of technologies best suited to his tastes.

The intelligent pickup system 1 also preferably includes gesture pad 17, which in the preferred embodiment is likewise mounted on the front 13 of the guitar 12. The gesture pad 17 is a manual user interface device (an "interface device" or "user interface"), analogous to a touch pad on a laptop computer, but with distinct additional capabilities. The gesture pad is used by the musician to issue control signals to the intelligent pickup onboard (i.e., on the instrument), and may also be used to issue such signals to any equipment off-board, provided that the gesture pad is equipped with appropriate wired or wireless communication capability to support any such communication, as will be discussed herein. Examples of such off-board equipment used in a typical musical performance include lights, amplifiers, mixers and off-board computers, and other devices. A "control signal" refers to either a command for a device to perform a specified action, or to a set of general purpose data, such as status updates, etc.

The gesture pad may also control additional intelligent pickup systems mounted on other instruments in a group of musicians. The gesture pad is an intuitive, gesture-centric device that requires no graphical user interface to supply feedback to the user; similar to playing an instrument, the user isn't required to look at the gesture pad in order to operate the gesture pad to control selected devices. Instead, the user receives tactile feedback from the manual gestures entered into the gesture pad, as well as feedback from the operation of the controlled device(s). For example, the user may receive audible feedback from music produced through use of the gesture pad. In addition, the gesture pad can translate the selected manual gestures directly into the desired control signal without intermediate translation by external computers. The operation of the gesture pad is discussed in more detail below.

A multitude of alternative mounting locations are also possible with the gesture pad. It may be mounted on any instrument or instruments, thereby giving any musician(s) in a group control over any other instrument(s) and/or equipment in the group. Still further, a gesture pad may be mounted on any piece of equipment related to the musical performance, and may be used by non-musicians, such as sound engineers or special effects technicians. The gesture pad can also be incorporated into a pick guard as a replacement to the standard pick guard 18 found on most stringed instruments. In essence, a gesture pad or gesture pads may be used by any person(s) associated with the musical performance, to control any instrument(s) or equipment, or special effects. There is no requirement that the gesture pad be placed on the instrument or equipment to be controlled, so long as wired or wireless connectivity is provided to allow the gesture pad to communicate with the selected equipment.

As best seen in FIG. 3, the details of an intelligent pickup 10 are displayed. As previously discussed, a traditional single-coil pickup has a set of magnetic poles, with each pole located in proximity to a respective string of the instrument, and with all of the poles collectively being encircled by a single conductive coil. When a user plays the strings, the respective magnetic fields of each pole of the pickup are disturbed by the vibration of the strings, thereby generating a corresponding electrical current (an analog signal) to occur in the coil. Since all of the poles of a traditional single-coil pickup are by definition encircled by a single conductive coil, only one electrical signal is produced for all of the strings collectively.

By contrast, in the preferred embodiment of the intelligent pickup 10 as seen in FIG. 3, a divided pickup configuration is used, in which each of several poles 20 has a corresponding wire coil 22 associated with it. As with a single coil pickup, each pole 20 of the intelligent pickup 10 is located in proximity to a respective string 24 of the guitar 12. The divided pickup thus creates a discrete analog electrical signal for each string 24 of the instrument 12. As noted previously, single coil pickups produce only a single electrical signal for all of the strings. It will thus be readily understood that a divided pickup is generally preferable to a single-coil pickup, as it offers the capability of processing a signal from each string separately.

Alternative embodiments of the intelligent pickup might also optionally include other types of transducers than the traditional magnetic-pole pickup. For example, the intelligent pickup could optionally use the well-known optical-laser, Piezo-electric, or ultrasonic transducer modes to convert the mechanical vibration of the strings into an electrical signal. However, the traditional magnetic-pole transducer is by far the most commonly used, and is therefore selected for use in the preferred embodiment.

In addition to having all the elements of a traditional pickup, the integrated transducer-processor unit 10 also includes a processor 26 for altering the electrical signal generated by the intelligent pickup 10, in order to produce selected musical effects such as pitch, volume, and tone. The intelligent pickup also includes electronics 28 to support the operation of the processor 26, and to provide interface capability for handling communication between the intelligent pickup and the gesture pad or other equipment. The interface electronics preferably include the necessary electronics for wired or wireless communication, such as USB, Wi-Fi and Bluetooth.

Advantageously, the processor 26 is also used to provide amplification of the signal from the intelligent pickup. This allows the poles 20 and coils 22 of the intelligent pickup 10 to be much smaller than the comparable poles and coil of a traditional single-coil pickup. This in turn allows the poles and coils of the intelligent pickup, as well as the electronics 28, to all be fit into a housing 30 of roughly the same size and shape (the same "form factor") as that of a traditional single-coil pickup. This may be seen by referring to FIG. 3, which shows a housing 30 having roughly the same form factor as a traditional single-coil pickup, and containing all the poles, coils, and processing electronics of the intelligent pickup. In a traditional single-coil pickup, that same housing would have been entirely filled with poles and coils. Thus the intelligent pickup 10 may be easily retrofitted into any traditional pickup locations, such as receptacles 16 *a, b*, or *c*. The intelligent pickup is further provided with standard wiring 32, which is designed to connect with wiring traditionally provided in such receptacles. It is possible that a more robust pickup could be designed, which would necessitate more electronic components than can be integrated into a single housing 30. In that case, the processing and electronics of the pickup could be distributed across one or more pickup housings having the same form factor as the preferred housing 30, for installation into one or more pickup receptacles. Still, no permanent modification of the instrument would be required, as the pickup could still be easily retrofitted into the existing receptacles.

Having all of the transducer components and processing components integrated into a single housing brings with it several advantages. For one, no external wiring is required to connect the component parts. This is aesthetically advantageous, and also greatly reduces potential problems with external wires, such as cross-talk, interference, and damage to fragile wires. In addition, problems involving complex installation of multiple wires are eliminated. Shielding to prevent interference may also be provided simply by constructing the housing from metal, or by providing a metal coating on the surface of the housing. Further, wiring may be built into a circuit board 34, and components may then readily be installed by inserting them into a corresponding modular slot in the circuit board, thereby greatly simplifying installation and removal of components. Finally, having transducer and processing components in such close proximity to one another eliminates the need for amplification of the signal emanating from the transducer, thus solving much of the problem of cross-talk between wires.

The processor 26 may vary in its power and capabilities, depending on the desired processing to be accomplished. The processor may optionally be a single component, or it may be a collection of discrete electronic components. Alternatives for processor components suitable for producing the desired musical effects are well-known in the art, and are a matter of choice of hardware, software, and/or firmware. The choice among processor alternatives will be determined by the desired performance, size, and other engineering goals, as well as by cost considerations.

One example of a processor which might be selected for use in the intelligent pickup 10 is a traditional microprocessor, which would first convert the analog electrical signal into a digital signal, then digitally process that signal to produce the desired results. In practice, when the instrument is played, a signal is produced which can then be passed on in digital format as an output signal to off-board equipment for conversion into musical sounds. For example, the output signal could go to a computer; or alternatively, the signal could be converted back to analog format more suitable for use as an output signal by traditional equipment, such as amplifiers, mixers, and the like.

Still other choices for use as the selected processor include any of a variety of specialized processor components—utilized either individually or in combination—such as microcontrollers, digital signal processors (DSP's) or field programmable gate arrays (FPGA's). Advances in technology and performance for all of these platforms has somewhat blurred the lines of distinction between these processor types, and any appropriate processor could optionally be used. Finally, these advances enable processors to be embedded into the subcomponents of a design in the most advantageous place, greatly enhancing the performance and capabilities that a distributed architecture can provide. A distributed processor architecture also allows the design to be more easily adapted to space constraints which can affect the ability to retrofit to an existing design.

Electric power for the processor 26 and electronics 28 is preferably provided by a rechargeable battery 36. Ideally for space and aesthetic purposes, the battery may be attenuated in length and width, with a corresponding minimal thickness. This attenuation would result in a battery with a very thin "wafer" shape, thus allowing flexibility in placing the battery on the instrument. For example, the battery might be unobtrusively affixed by the user to the back, side, or bottom of the instrument, preferably using any non-permanent adhesive technology, such as harmless glue or a simple self-adhesive strip attached to the battery. Such a configuration is depicted in FIG. 1, with the battery 36 attached to the bottom of the instrument 12, and electrically connected to the intelligent pickup 10 by a wire which extends through the inside of the instrument.

Alternatively, the pickup 10 and the battery 36 could be connected to one another by extending a wire internally through the hollow inner portion of the instrument. If the battery 36 and the pickup 10 could be made thin enough, the battery might even fit into the receptacle 16*a* with the intelligent pickup itself, or into an unused pickup receptacle where it can be easily connected to an intelligent pickup in an adjacent receptacle. This configuration would be optimal, as it would require no connecting wire to extend across or through the instrument between the battery 36 and the pickup 10. Such a configuration would also simplify the installation of the pickup, and would have no aesthetic drawbacks.

Finally, the intelligent pickup could take advantage of emerging standards in wireless power transmission across short distances. One such standard is called Qi (pronounced "chi"). This technology utilizes a form of resonance induction. A battery pack could be mounted on the back of the instrument. Within the battery pack, the Qi transmitter could be located. The Qi receiver could be located on the underside of the intelligent pickup. When installed in the desired pickup receptacle, would receive the wireless power transmission through the body of the instrument from the battery pack which is generally less than two inches As also seen in FIG. 3, indicator lights 40, 41, 42 and push button 44 are provided on the pickup 10. The lights indicate various states of the intelligent pickup to the user, such as power on-off, error messages, operation status, and so forth. The push button allows the user to cycle through pre-sets, operations, etc., as will be discussed. Optional USB port 46 may be provided, although in general wireless communication is preferred.

Figure 4:
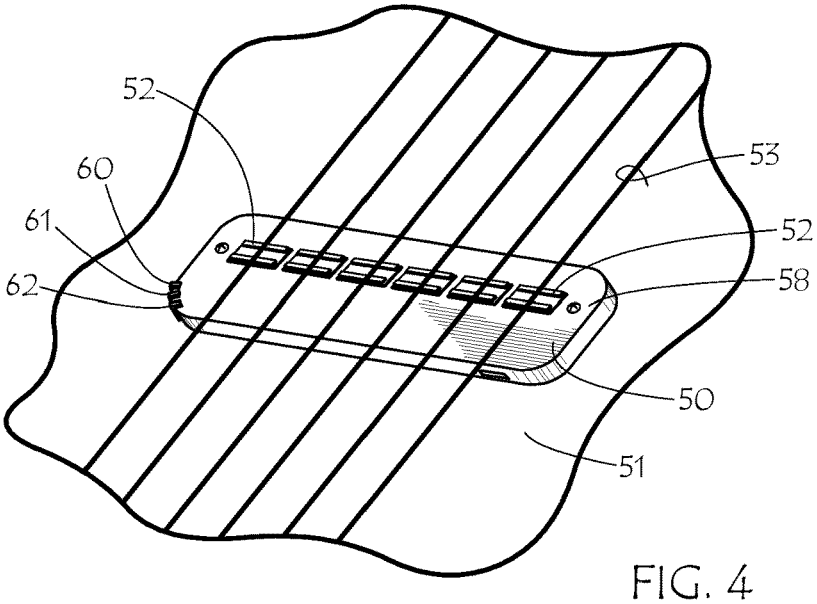
FIG. 4 is a perspective view of an embodiment of the intelligent pickup adapted for fitting under the strings of an instrument having no pickup receptacles.
Figure 5:
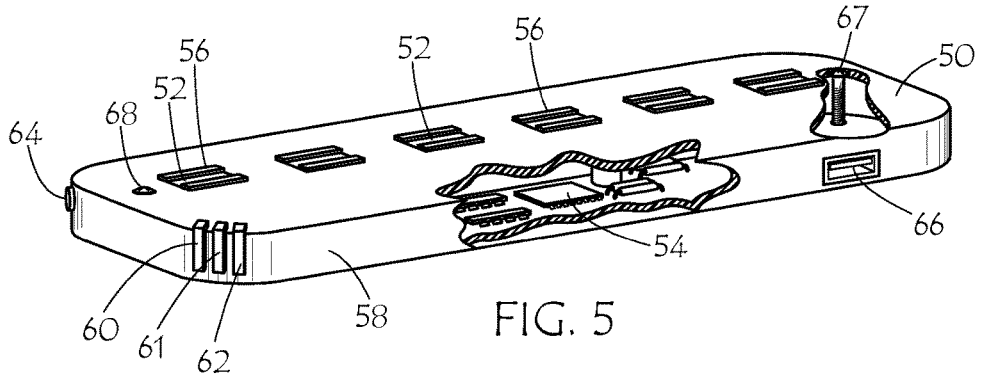
FIG. 5 is a perspective view of the pickup of FIG. 4, with a partial cutaway showing the inner electronics and processor.

Referring now to FIGS. 4 and 5, an alternative embodiment 50 of the intelligent pickup is shown, for use with a stringed instrument 51 which has no receptacles for receiving a pickup. For example, instruments such as a fiddle, an acoustic guitar, a violin or a banjo would typically have no such receptacles. However, an intelligent pickup could still be easily retrofitted to such instruments by making some minor adjustments. For one, the intelligent pickup 50 would be adapted for attachment to the instrument by use of harmless rubber glue, a self-adhesive strip, or the like; as the instrument would not typically be configured to receive a standard mounting base 14, as depicted in FIG. 3.

Figure 6:
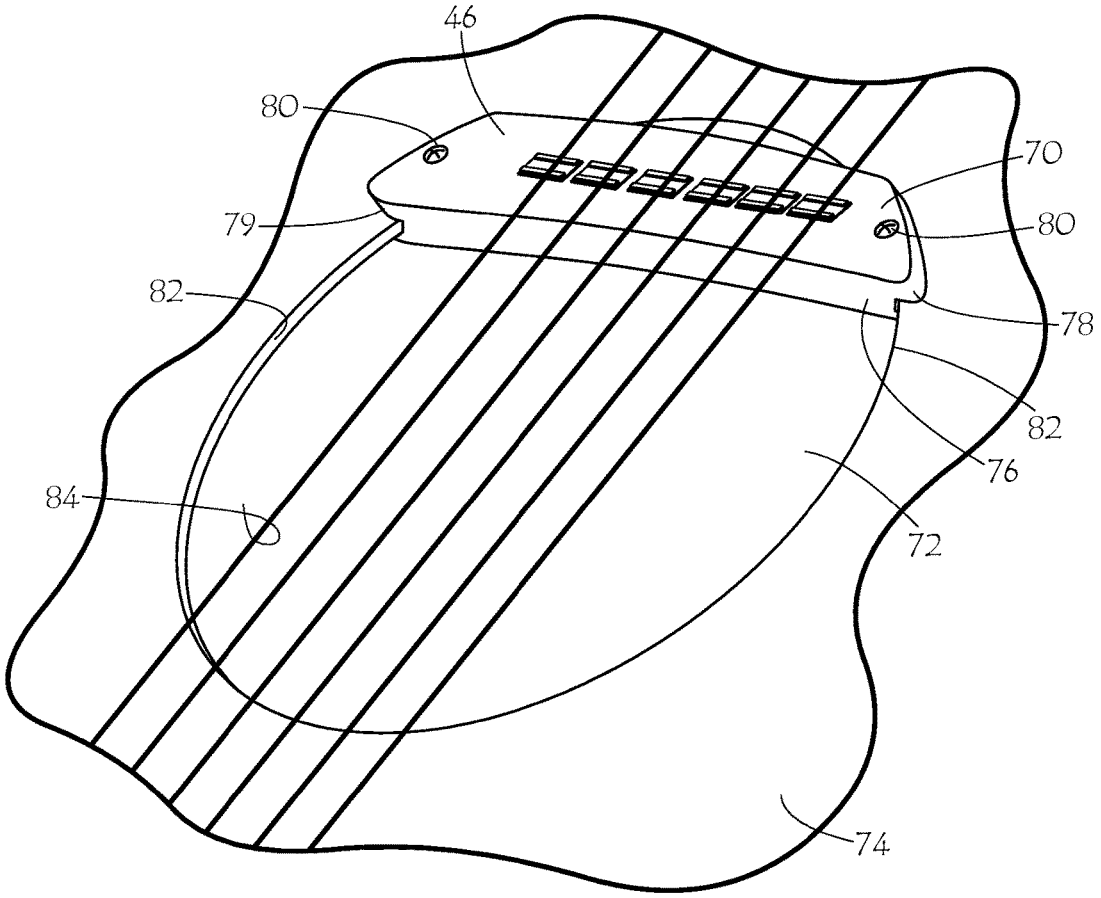
FIG. 6 is a perspective view of an embodiment of the intelligent pickup adapted for mounting in the sound hole of an acoustic guitar.

In addition, since the poles 52 of the intelligent pickup 50 must be placed in proximity to the strings 53 of the instrument 51, the intelligent pickup would most conveniently be mounted underneath the strings (the pickup could be mounted above the strings, but that would require an unsightly and inconvenient mounting bracket). However, with no traditional receptacle in which to place the intelligent pickup, the pickup could easily be too tall to fit under the strings. As may be seen in FIG. 5, this height issue may readily be addressed by positioning the processing elements 54 and the transducer elements 56 side-by-side, rather than stacking the transducer elements above the processing elements as in the preferred embodiment of FIG. 3. In this way, the intelligent pickup 50 may be made to fit into a wider and thinner housing 58, so as to easily fit under the strings 53. In like fashion as the earlier embodiment of the intelligent pickup 10, this modified version of the pickup 50 optionally includes indicator lights 60, 61, 62, push switch 64, and USB port 66. Adjustment screws 67, 68 may be provided to allow the transducer elements 56 to be raised or lowered, in order to achieve optimal proximity to the strings 53. Referring now to FIG. 6, another embodiment of the intelligent pickup 70 is shown mounted in the sound hole 72 of an acoustic guitar 74, secured by use of a mounting base 76. The mounting base 76 includes mounting clamps 78, 79, which may be tightened or loosened by adjusting screws 80 so as to be easily attached to or removed from the sides 82 of the sound hole 72. When the intelligent pickup 70 is mounted in this way, the housing 46 of the preferred embodiment may be utilized with only minor modification, as the sound hole 72 provides ample space to allow the intelligent pickup 70 to fit underneath the strings 84 of the acoustic guitar 74. While the processor alternatives for the intelligent pickup are virtually unlimited, certain parameters of signal and processing flow through the processor are common to all such alternatives.

Figure 7:
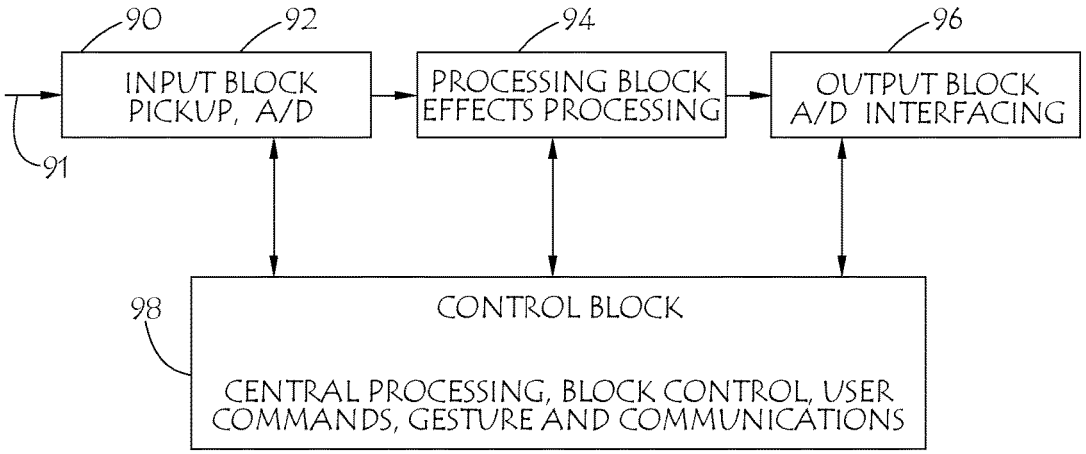
FIG. 7 is a flow chart displaying the signal flow through the processor of the intelligent pickup.

Referring now to FIG. 7, flow chart 90 depicts a typical signal and processing flow through the processor of the intelligent pickup. An initial analog signal 91 generated by transducing performed by the pickup 10, as previously described, is shown being introduced into Stage I 92 of the processor. In Stage I, the voltage, amperage, and other selected parameters of the signal will typically be modified to prepare the signal for effects processing to be performed in Stage II 94. In particular, in the preferred embodiment, the signal 91 is preferably converted from an analog to a digital format, which is more suitable for processing in Stage II. The signal might alternatively be processed in its analog state, but processing is generally more readily accomplished in a digital context.

Stage II 94 includes processing to be performed on the signals resulting from the operations performed in Stage I.

This process results in certain musical "effects," i.e., alterations in the signal for musical purposes. The most common of these musical effects are pitch alteration, equalization ("tone"), and volume modification. The preferred embodiment will typically include processing of those three basic effects at a minimum, and may optionally include processing to produce other effects as well. Simplified embodiments may include the capability of processing only one or two of those effects, for example volume and tone. On the other hand, a more robust embodiment may include additional optional effects such as delay, reverb, or phase-shifting. Other effects could be added, depending on size and performance constraints.

The processor preferably utilizes algorithms to create the desired effects. Many of the mathematical parameters of these algorithms can be adjusted in real-time according to the desired musical effect. For example, the pitch effect may optionally have a parameter to adjust the pitch of the input signal in semitones (notes). As another example, the equalization effect may optionally have one parameter to specify the type of equalization, and others to specify the frequencies to boost or attenuate. These effect parameters can be modified by the user, and stored in the processor memory for later recall by the user. A collection of stored effect parameters stored in this manner are commonly referred to as "pre-sets."

In Stage II, the processing may selectively occur in serial or parallel sequencing, depending on which manner is best suited for the desired results. For example, in a serial processing mode, the input signal might first be routed through an equalization effect process, then through a pitch effect process, and finally through a volume effect process. The resulting signal, with its equalization, pitch and volume sequentially modified as desired, is then ready for output to Stage III.

Alternatively, the same signal could be copied and processed as several signals in parallel fashion, then remixed together to create a resulting signal ready for output to stage III. In such a parallel process, the input signal would first be copied to create two identical signals. One of these identical signals would then be routed through an equalization effect process, while the other signal would be simultaneously routed through a pitch effect process. The resulting signals would produce a sound which appears to be that of two instruments, one at normal pitch and the other at an altered pitch (such as an octave higher). Each of the resulting signals would then be routed through a volume effect process, after which the signals would be mixed together into a single signal for output to Stage III.

In Stage III 96, the signal from Stage II 94 is processed to make it suitable as an output signal for interfacing with a variety of interface formats. For example, conventional external amplifiers, mixers, and the like are typically compatible with traditional analog electric guitar signals. Thus it may be desirable to convert the signal from a digital to an analog format suitable for interfacing with such equipment. Conversely, the signal might be left unaltered from its digital format, in order to facilitate interfacing with an off-board computer, or other digital-compatible equipment. Additional embodiments could provide this digital audio in formats such as WAV, MP3 or surround sound formats such as DTS and Dolby AC-3. Additional interface formats potentially include a micro-USB or Firewire interface for providing direct digital interfacing to computers. It may also be advantageous to include wireless interfaces such as Bluetooth or Wi-Fi. The electronics for providing such wireless capability are well known, and may be incorporated into either the intelligent pickup, the gesture pad, or both. After being processed as desired in Stage III, the properly conditioned signal 97 exits the pickup for external use.

Associated with each of the Stages I-III are the control functions 98. These functions provide real-time control of all processes running within Stages I-III, such as effects, routing and mixing processes. These controllable functions are initiated by input mechanisms such as the gesture pad, strap button, foot controller, automation or remote control, which allow modification of effects parameters as previously discussed. There are also automatic control functions which are utilized outside of Stages I-III to manage the over-all operation of the intelligent pickup, e.g., control functions for managing battery power, processor performance, the user interface device, communication error recovery, etc.

In addition, the control functions can be expanded to also include communications interfaces such as Wi-Fi, Bluetooth, and USB, which allow communication between the intelligent pickup and other equipment such as computers and mixers. This communication capability coupled with the intuitive gesture pad allows the intelligent pickup to transmit control signals to off board equipment such as lighting systems, computers, and mixers, or other intelligent pickups.

One example of a control signal would be through the use of common Internet protocols, such as those used with web browsers. Since the intelligent pickup system will preferably incorporate Wi-Fi, it will inherently be able to communicate in any number of common Internet protocols. Another example of a standard control signal that might be incorporated is one compatible with DMX-512, a standard command and communication protocol, which is widely used in controlling stage lighting. "Command & Communication Protocol," or "Communication Protocol," refers to a set of standardized procedures for conducting data communication between electronic devices. A protocol may reside in either hardware, software, firmware, or any combination thereof. A protocol may also be either proprietary or non-proprietary. Examples of commonly used non-proprietary protocols include MIDI, DMX-512, X-10, TCP/IP, etc.

In short, the lines of communication with the intelligent pickup system are limited only by choice and convenience. For example, any given intelligent pickup may communicate with any piece(s) of equipment, either onstage or offstage. This offers extensive opportunity for collaboration among musicians on-stage, as well as with any off-stage equipment or personnel. Just one such possibility would be two musicians on-stage artistically coordinating a light show and pyrotechnics with music they were performing at the time.

Numerous variations and combinations of the foregoing embodiments are possible, with each having its own advantages for particular situations and goals. Optimally, the intelligent pickup will be paired with a gesture pad with which to control it. In this variation, the gesture pad will typically be mounted on the instrument itself, thereby allowing the musician to directly control the intelligent pickup. The gesture pad and the intelligent pickup would both be equipped with communication electronics, to allow them to interact by sending and receiving signals to one another.

The intelligent pickup 10 also preferably has communication electronics which allows it to receive signals from and be controlled by a wide variety of other external equipment, thus allowing any such equipment to act as an interface device for issuing commands to and controlling the processor of the pickup. The intelligent pickup thus would also have the capability to send signals to and control such equipment. For example, strap button 110 may be configured to send signals to the intelligent pickup when the musician exerts a pressure on the strap button through a stretching action on the guitar strap 112, which is connected to the button 110. In one embodiment, the strap button would merely be an analog force transducer connected by wire 111 directly to the intelligent pickup, and would transmit an analog signal directly by wire to the intelligent pickup, where the processor 26 would translate the analog signal into a control signal and take the indicated action. In an alternate embodiment, the button would be provided with its own processor which would translate the analog signal into a digital control signal translated wirelessly to the intelligent pickup, preferably using MIDI, or another appropriate communication protocol.

Alternatively, various other interface devices might utilize a force transducer in like fashion to generate control signals for controlling the intelligent pickup. For example, a common device such as a musician's foot pedal could be outfitted with a force transducer in the same manner as the strap button. Alternatively, force transducers as described, could also be incorporated to be worn on the body or slipped into the shoe of the artist as "wearable controllers," further enhancing the aesthetics and intuitive control A still further option would be for the intelligent pickup to be controlled by an off-board computer. The intelligent pickup may also optionally contain a MEMS (micro-electromechanical systems) chip which enables the intelligent pickup to respond to gentle shaking of the instrument. This type of chip could be used to generate a vibrato effect (an effect which raises and lowers at a specified frequency). Other musical equipment such as mixing boards, MIDI controllers, electronic pianos, keyboards, and the like may also exercise control of the intelligent pickup through compatible communication electronics and protocols. The exercise of such control may be exclusive, wherein only one piece of equipment may act as the interface device for the intelligent pickup; or more commonly, such control may be open, wherein any number of pieces of equipment may act in turn as an interface device with respect to the intelligent pickup. Further, in addition to or in place of the primary gesture pad typically located on the instrument itself, other gesture pads may be utilized to interface with the intelligent pickup. Such gesture pads can optionally be placed in any convenient location, such as on other instruments, on keyboards, or almost anywhere off-board. From any of those locations, a gesture pad may control the intelligent pickup, so long as both are equipped with suitable communication electronics, which would preferably include wireless capability. The intelligent pickup would also optionally include communication electronics which would allow it to send signals to and to control any of the aforementioned equipment.

In an embodiment of the invention which includes the intelligent pickup with strap button 110 attached to strap 112, the intelligent pickup may optionally be pre-programmed to emulate a well-known customized guitar commonly referred to as a "B-Bender" guitar. In a traditional customized B-bender guitar, when pressure is applied to the strap button by a stretching action on the guitar strap 112, a series of mechanical parts is activated, causing the B-string pitch to be raised. In the intelligent pickup version of the B-Bender, when the strap 112 applies pressure to the button 110, the pickup itself would be instructed to raise the pitch electronically. Advantageously, this allows the pitch to be precisely controlled, and also to be altered in any way desired. Still further, the pitch of any string—or even all strings—could be altered by the pickup, and not merely the B-string.

The intelligent pickup may also be controlled by commands, notes, and conditions generated by the intelligent pickup itself. Such commands, notes, and conditions may also cause the processor of the intelligent pickup to issue control signals, for internal use in directing its own processing of electrical signals, or for external use such as transmitting the control signal to control an external device. For instance, the intelligent pickup could be configured to output an alarm tone when the battery is running low. The intelligent pickup could also be configured to perform any selected action in response to a specified series of notes being played on the instrument. For instance, the pickup could be commanded to change to a selected pre-set when a particular series of notes is played.

Commands may also be specified individually or in a sequence of commands (a "script"). For example, when a specified series of notes are played, a command may be issued which references a script to be executed. This script could include a sequence of commands which would change pre-sets and then mute the volume. The action could also be a control signal which is transmitted to control a remote device. For instance, a command could be issued to bring the stage lights down. Thus, based on the foregoing examples, it may be seen that an appropriately configured intelligent pickup could operate successfully in a wide variety of ways with no external source of control whatsoever.

The functions of the intelligent pickup may be selectively limited if desired, in order to save space and processor power, and also to provide for simplified operation. For example, in one such simplified embodiment, the intelligent pickup is dedicated solely to emulating selected pickups, and preferably does not include capabilities to handle pitch, remote control, wireless communication, or other processor-intensive functions found in the fully functioned intelligent pickup. For clarity purposes, this simplified version of the intelligent pickup may be called the "pickup emulator," to distinguish it from the fully-functioned intelligent pickup. The emulator would typically be an entirely separate and distinct device from the fully functioned intelligent pickup. However, a fully functioned intelligent pickup might also be equipped with an emulator mode, in which it would behave exactly as would a separate and distinct emulator.

The pickup emulator (or a pickup operating in emulator mode) has processing capability which allows it to reproduce the basic operating parameters of a selected limited number of pickups, preferably in the range of 4-8 such emulations. Typical parameters to emulate would include equalization, volume, and frequency response, along with any other parameters useful for accurately emulating a pickup. A collection of such parameters for a particular selected pickup is commonly referred to as a "pre-set." Users of the pickup emulator could be provided with pre-set parameters for emulating a number of popular pickups, ideally by downloading the pre-sets from a website. USB port 46 may optionally be provided to allow the user to connect to a computer or other device for downloading purposes. Alternatively, Wi-Fi or wireless electronics could be provided for such purposes, although a USB connection is generally preferable. The pickup emulator would thus allow the user to sample popular pickups, and choose the one or ones which best suit him at any given moment.

Once the desired pickup pre-set emulations have been downloaded into the emulator, the user may then scroll through the stored emulations using scroll button 44. Indicator lights 40, 41, 42 may be used to indicate which pickup emulation is in use at any particular time. The user may modify an existing pre-set by using the configuration management software. To do so, the user first sets up his equipment, including his guitar, pickup emulator, and sound system. Then, by connecting to through the USB port to a computer or other device running the configuration software, he may use the configuration software to alter the parameters of any selected pickup pre-set. In this process, he may listen to the effects produced by the emulated pickup, and effectively "tune" the pickup emulation to match his own tastes. The user will thus have the capability to not only select a popular pickup of his choice, but also to alter the characteristics of that pickup to suit his own tastes.

Figure 8:
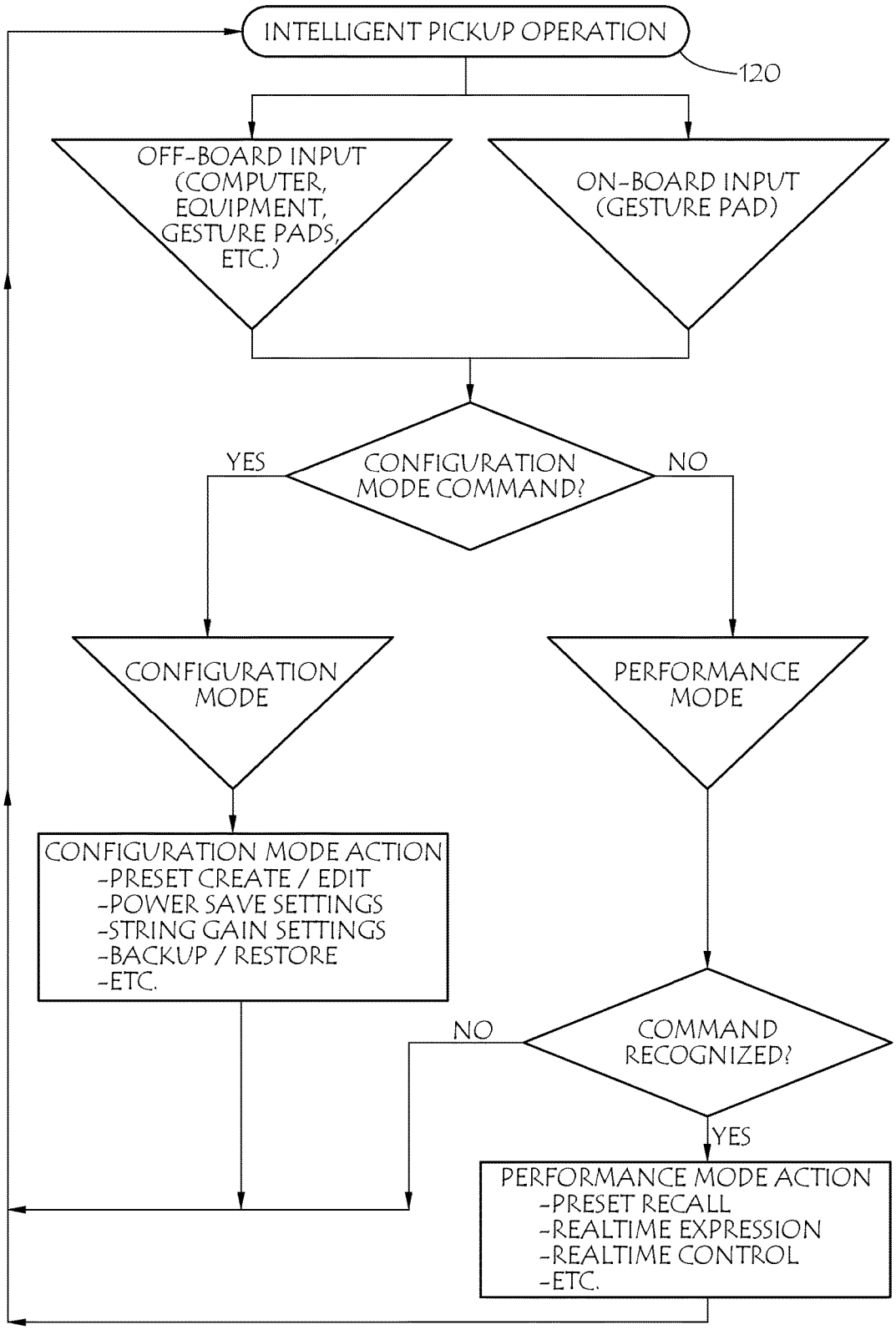
FIG. 8 is a flow chart showing the actions in the operation of the intelligent pickup.

Referring now to FIG. 8, the actions in the above-described operation of the intelligent pickup are presented as a flow chart 120. As previously discussed, input is first received from an onboard or off-board source. The intelligent pickup then determines a configuration command has been issued. If a configuration command has been issued, the configuration mode actions are taken, after which the pickup awaits it next instruction. On the other hand, if no configuration command has been issued, the pickup takes the requested action in performance mode, after which the pickup awaits its next input. The operational flow indicated in flow chart 120 continues indefinitely, or until the intelligent pickup is powered down.

Figure 9:
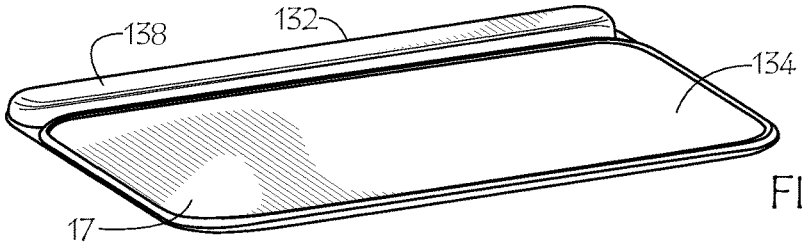
FIG. 9 is a perspective view of the gesture pad.
Figure 10:
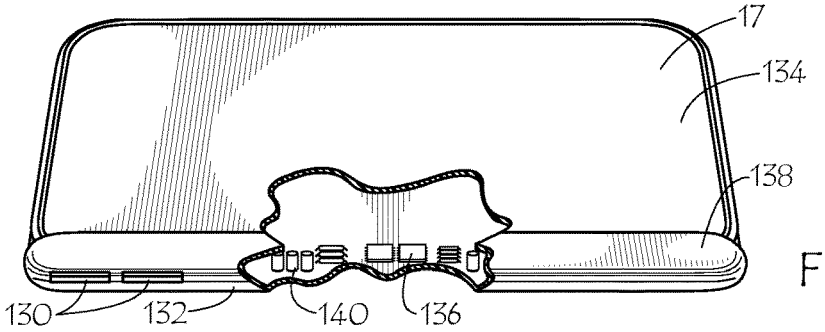
FIG. 10 is a perspective view of the gesture pad, with a partial cutaway showing the inner electronics and processor of the gesture pad.

As depicted in FIGS. 9 and 10, the gesture pad 17 is preferably constructed of a durable, flexible, and substantially transparent material such as Mylar. The gesture pad optionally has a thin, flat, substantially transparent configuration which advantageously allows the gesture pad 17 to unobtrusively blend in with any instrument, thereby maintaining the aesthetics of the instrument. The gesture pad may preferably be adhered to the instrument by static adhesion, or by a harmless rubber glue or other non-permanent adhesive technology which can easily be removed without damage to the instrument. Optional LED lighting 130 located along the top edge 132 of the gesture pad 17 may be provided to supply the artist with additional feedback on the system's operation and status. Depending on its anticipated use, the gesture pad may be of almost any size and shape, subject only to aesthetic judgments, and/or the physical constraints of the instrument or equipment, and also technological constraints such as the size of the gesture pad's components. Of course, for practical purposes the gesture pad must be made large enough to allow the user to conveniently make recognizable gestures, and small enough to be unobtrusive. Since the gesture pad is preferably constructed of highly flexible and transparent material, it will easily blend in with and conform to any surface to which it may be applied. As discussed, in the preferred embodiment the gesture pad is constructed of a thin, highly flexible, transparent material such as Mylar. However, any or all of those qualities of the material may be varied, depending upon the intended use of the gesture pad and the preferences of the user. For example, when the gesture pad is to be used on equipment or an instrument other than a guitar, an opaque gesture pad might actually be preferred, for functional and/or aesthetic reasons. Similarly, a thicker or more rigid gesture pad might also be selected, again for any functional or aesthetic reason.

As will be seen from the discussion that follows, the gesture pad acts as a manual interface device for issuing command and control signals to the intelligent pickup or other equipment. As shown in FIGS. 9 and 10, the gesture pad includes a thin, flat sensor pad 134 constructed of material having sensor electronics on the surface of the pad or embedded within the pad, as is well-known in the field of touch pads. Similarly to the familiar touch pad on a laptop computer, input is, manually entered by the user's fingers (or "digits," since the user could clearly use his thumb in entering gestures into the pad) acting upon the surface of the pad 134. When finger tip motions (a "gesture") are made on the pad, the sensor converts the finger-tip pressure and position into analog electrical signals, which constitute a set of data defining that gesture in terms of X, Y values for position and Z values for pressure. In one embodiment, these data sets are sent directly to a processor 136 within the gesture pad, where they are converted to digital data sets of X, Y, and Z values. The X and Y values represent position on the pad surface, while the Z values represent the relative amount of pressure applied to the pad. This applied pressure can be used to represent a range of Z values, or as a threshold value in which only the presence of a touch is required.

Optionally, the sensor pad itself may contain a minimal processor such as a microcontroller for converting the analog electrical signals into digital values for X, Y, and Z, as well as for storing these digital values as they are assembled into gestures for transmission. In the preferred embodiment, the gesture pad contains the simple processor 136 for interpreting the stream of X, Y and Z values. These XYZ data sets are analyzed by the gesture pad processor 136, looking for any gesture (represented by a data set of XYZ values) which is recognizable as being equivalent to a gesture (data set) found in a stored array of predefined gestures. Preferably, the array is stored in the processor of the gesture pad, although it could be stored in the intelligent pickup or elsewhere, as will be discussed. The user operates the gesture pad by making manual gestures on the pad, with a particular gesture being selected by the user to match a gesture from the array of predefined gestures. When the user inputs a gesture from the array of predefined gestures, that entered gesture is recognized by the gesture pad processor, then translated into a control signal associated with that gesture, as will be discussed. The control signal is issued in accordance with a command and communication protocol common to both the gesture pad and the equipment to be controlled. This control signal may then be sent to the selected equipment, which in turn interprets the signal and acts in accordance with it. In this way a connection is established between the gesture pad and the selected equipment, through which the gesture pad may control the equipment via signals initiated by the gestures entered into the gesture pad 17. Optionally, the processing for recognizing gestures and issuing associated control signals could be handled by a processor in the target device, or even in an off-board computer in communication with both devices.

In practice, the gesture pad 17 would first need to be programmed so that each recognized predefined gesture is associated by its processor 136 with a respective selected control signal available within the communication protocol. As discussed, the collection of recognized predefined gestures constitutes an array of data sets representing X, Y, and Z values. The desired programming could be performed by the vendor, by the user, or preferably by the vendor first and then optionally modified by the user during a set up operation. In this way, the vendor could handle programming of certain common gestures and associated commands, and the user would then alter those common gestures and commands to suit his own tastes, and could also add gestures and commands of his own. When setting up the gesture pad in this way, the user would typically utilize a computer program to configure the expected gestures and command translations (using, for example, a communication protocol such as MIDI, DMX-512, etc.), with the computer and the gesture pad connected via any suitable wired or wireless protocols, such as Wi-Fi, Bluetooth, or USB. Alternatively, or additionally, the intelligent pickup itself could also include the processing capability to configure the gesture pad when the two were appropriately connected.

Figure 11:
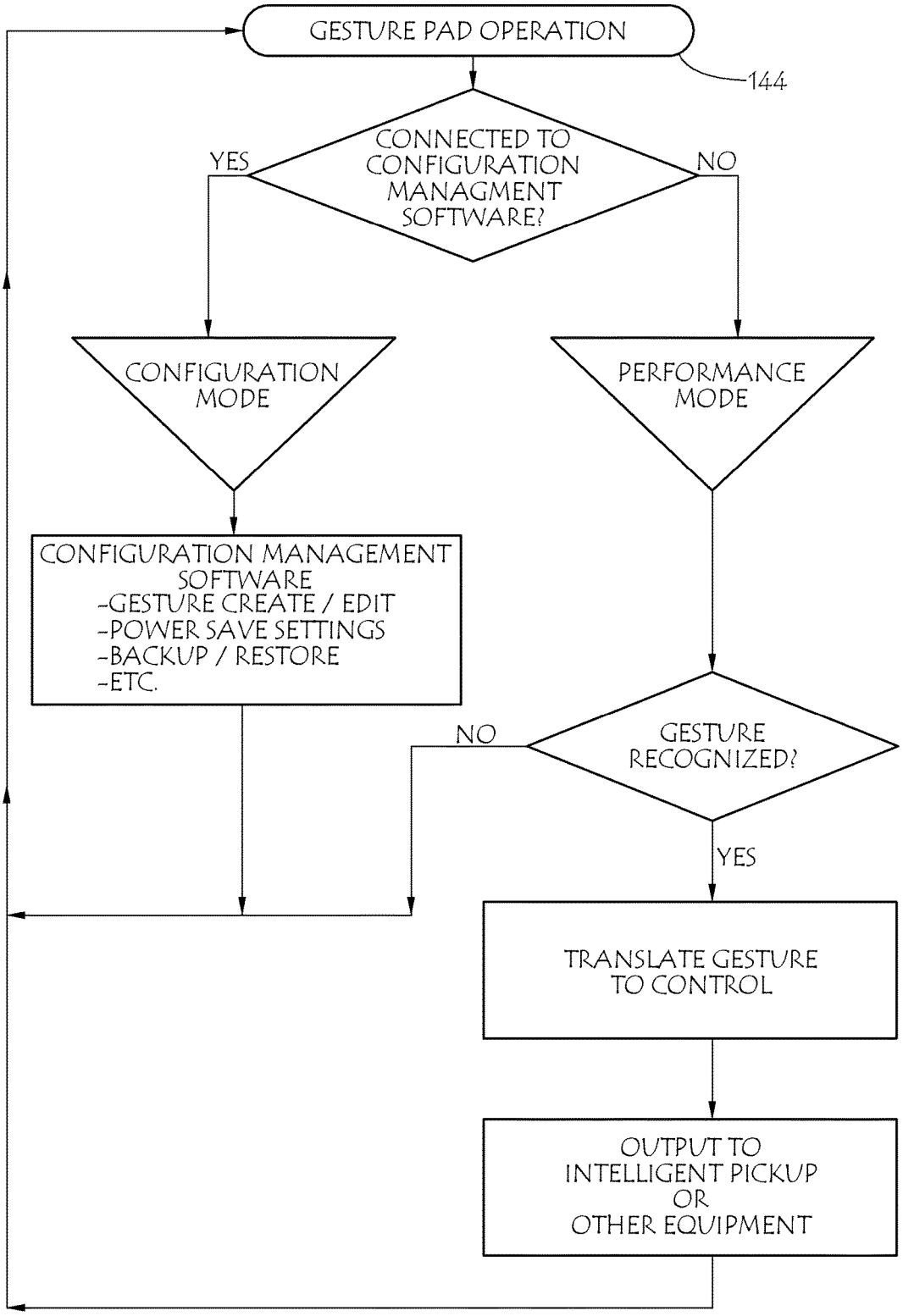
FIG. 11 is a flow chart showing the operation of the gesture pad.

Referring now to FIG. 11, a flow chart 141 shows the operation of the gesture pad. The gesture pad processor is pre-programmed to operate in one of two modes, either: (1) configuration mode; or (2) performance mode. The configuration mode is utilized to configure the gesture pad, while the performance mode is used when the gesture pad is involved in an actual musical performance. As also may be seen in FIG. 11, the gesture pad will automatically enter into configuration mode whenever it detects that it is connected to configuration management software. The configuration management software is preferably capable of configuring both the intelligent pickup and the gesture pad, and will typically be run by a computer to which the intelligent pickup or the gesture pad is connected. Alternatively, the configuration management program may be run either from the Internet or from the gesture pad itself, typically as a web-enabled application accessed through a browser. It would also be possible for the configuration software to be run from the intelligent pickup, but this could take up valuable processor power and may therefore not be an attractive option.

Once the gesture pad is in the configuration mode, the user will be presented with an initial main menu not unlike typical menus found in many familiar programs. For example one suitable opening set of choices from the initial main menu would offer the user three options: (1) GESTURE, and under that, (a) CREATE; and (b) EDIT; (2) POWER SAVE SETTINGS; and (3) BACKUP/RESTORE. From the opening selection, the user would then proceed to various sub-menu choices.

Pre-programmed gestures can be assigned or reassigned to pre-programmed control signals by first selecting GESTURE, then EDIT, from the main menu. The pre-programmed array of gestures would consist of gestures preselected for their distinctiveness and intuitiveness in a musical performance environment. This array of gestures would have set X, Y, and Z parameters predefining their shape, so as to allow them to be recognized by the processor.

Alternatively, the user has the option to create a custom predefined gesture of his own design. To do so, the user would simply utilize the gesture pad to "draw" the gesture, which will also appear on the screen. The software will automatically verify that the gesture does not conflict with other stored gestures and alert the user when a conflict occurs. Should a conflict occur with an existing gesture, the user will be advised of the conflict and given a chance to correct it. Once the user has selected or created a gesture from the array of predefined gestures, or created his own gesture accepted by the software, he will be asked to confirm his selection, then to close the window.

Next, the user will select a command to be associated with his newly selected gesture. The software will display the appropriate command selections from which the user can choose a command to associate with the new gesture. For example, if the gesture pad is programmed to support MIDI (Musical Instrument Digital Interface, a universally used communication protocol in the music industry), the user would have the option of selecting from one or more of the control signals supported by the MIDI standard, e.g., increase the volume, select a piano sound, etc. The user can also construct a sequence of these commands into what is often called a "script." These scripts can also be associated to gestures, in the same manner as is a single command Finally, the user will be presented with a CONFIRM/CLOSE option, in which he confirms his choice and exits the gesture-creation mode.

The performance mode of the gesture pad is activated whenever the gesture pad is turned on and is not connected to configuration management software. Once in performance mode, the user may enter a selected gesture to activate the gesture pad. When making such a gesture, the user would choose a gesture which he intended to be recognized by the processor as one of the array of predefined gestures. The gesture pad first checks to see if the gesture is a recognized gesture currently having a control signal associated therewith. If the gesture is so recognized, the gesture pad translates the gesture to its associated command, and sends that command to the intelligent pickup or to other equipment for implementation.

As an example, a simple gesture applied to the gesture pad might include merely a single "tap," which would constitute a single set of X and Y coordinates along with a Z (pressure) value within an expected range of values. This gesture might be utilized as an "on/off" command by the intelligent pickup or other equipment. A more complex example of a gesture might be one in the shape of a circle, performed in either a clockwise or a counter-clockwise direction. This gesture would constitute a series of X and Y coordinates approximating the shape of the circle, along with a certain Z (pressure) value within an expected range of values. Such a circular gesture might be utilized as a simulated volume knob, with the clockwise motion being used to increase the output volume of the intelligent pickup, and the counter-clockwise motion being used to reduce the output volume.

As noted above, a selected array of predefined gestures is preferably pre-programmed into the intelligent pickup, and includes gestures selected for their distinctiveness and intuitive meaning for navigation and operation in a musical environment. Referring now to FIGS. 12-19, a sampling of such possible gestures is shown.

Figure 12:
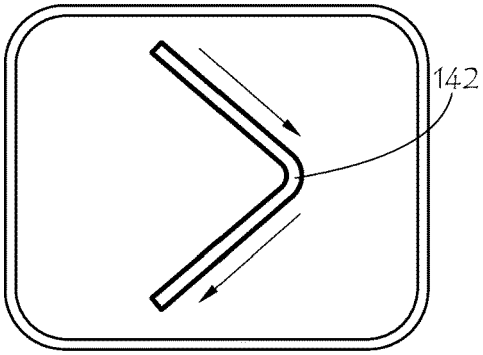
FIG. 12 is top view of the gesture pad, showing the entry of a potential gesture into the pad.
Figure 13:
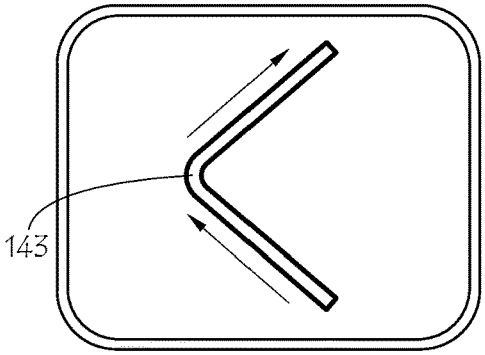
FIG. 13 is top view of the gesture pad, showing the entry of a potential gesture into the pad.

The gestures 142, 143 of FIGS. 12 and 13, for example, could represent multiple standard navigational commands for operating the intelligent pickup such as, "NEXT" and "PREVIOUS," or "FORWARD" and "BACKWARD" in a menu selection context. Thus, when the user is sequencing through a selection of configuration settings, the user could use these two gestures to sequentially navigate forward or backward through a list of configuration settings. The user might use "UP" and "DOWN" gestures (similar to FIGS. 12 and 13, except oriented to "point" up and down), to increment or decrement a settings value.

Figure 14:
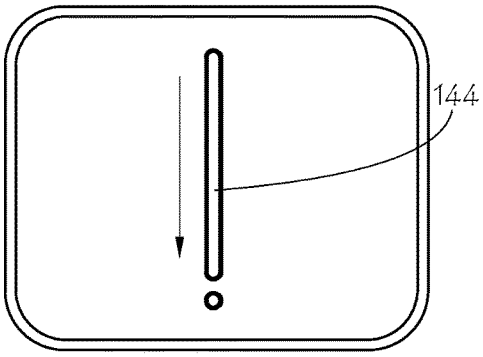
FIG. 14 is top view of the gesture pad, showing the entry of a potential gesture into the pad.
Figure 15:
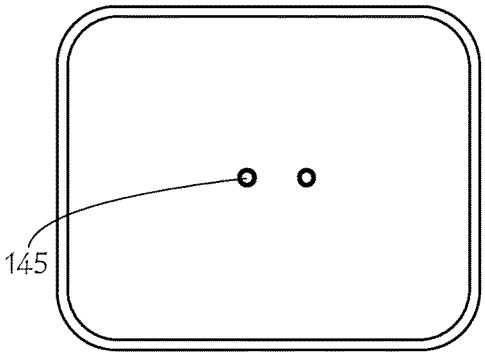
FIG. 15 is top view of the gesture pad, showing the entry of a potential gesture into the pad.

As seen in FIG. 14, a gesture 144 is shown which would cause the intelligent pickup to enter into a power shutdown mode, in order to conserve battery power when the intelligent pickup is not in use. In FIG. 15, a gesture 145 is depicted which could represent a standard navigational command such as an "OK" or "ENTER", for accepting a configuration setting value, which may in turn have been set using the gestures 142, 143 of FIGS. 12 and 13.

Figure 16:
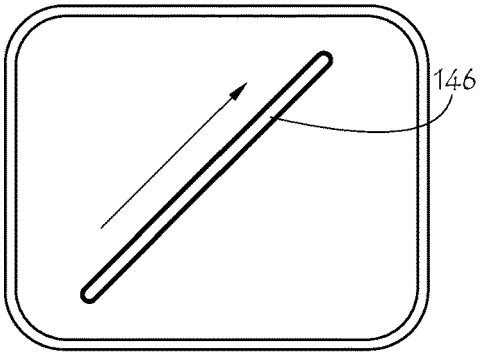
FIG. 16 is top view of the gesture pad, showing the entry of a potential gesture into the pad.
Figure 17:
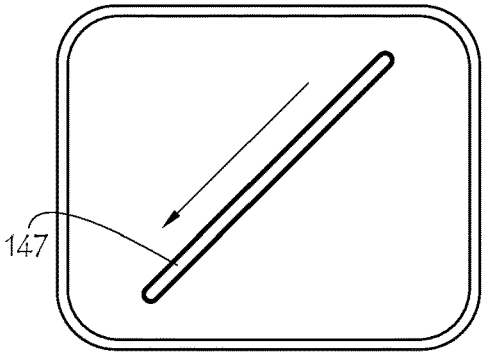
FIG. 17 is top view of the gesture pad, showing the entry of a potential gesture into the pad.
Figure 18:
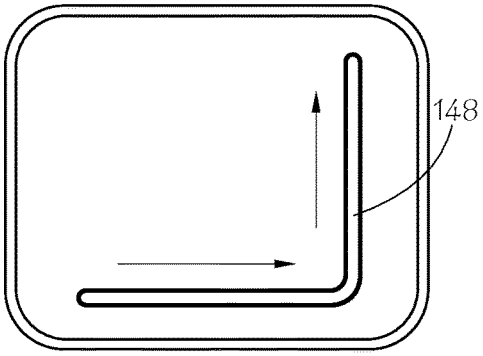
FIG. 18 is top view of the gesture pad, showing the entry of a potential gesture into the pad.
Figure 19:
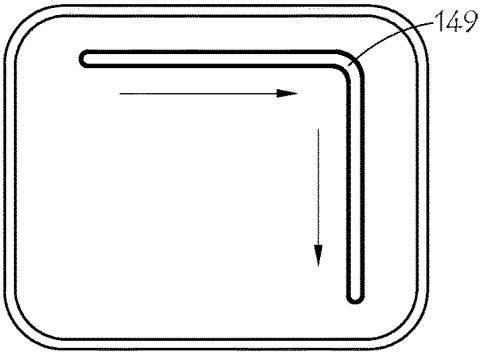
FIG. 19 is top view of the gesture pad, showing the entry of a potential gesture into the pad.

FIGS. 16 and 17 show gestures 146, 147 which could be used to operate a "wah" effect in real-time when the intelligent pickup is in performance mode. When the user makes gesture 146, it would increase the effect, while entering gesture 147 would decrease the effect. FIGS. 18 and 19 show possible gestures 148, 149 which could be used to operate a "volume" effect in real-time when the intelligent pickup is in performance mode. These gestures could operate similarly to a volume knob in which turning the knob clockwise—the gesture 149—increases the volume, while a counter-clockwise motion—as in gesture 148—would decrease the volume.

In practice, the user selects a manual gesture which matches a gesture from the stored array of predefined gestures, in order to elicit the desired control signal associated with that predefined gesture. As may be seen from the sample gestures of FIGS. 12-19, selected gestures often consist of combinations of movement of the digits of the user along several directions, including horizontal, vertical, and diagonal. The gestures may also include arcs, as for example when a circle is traced with the digits. The gestures are typically entered by the user moving his digits between two or more points on the surface of the pad. The X, Y, or Z-pressure may also be continuously or intermittently varied by the user to create gestures intuitively associated with certain special effects, such as wah or vibrato.

It should be noted that gestures can be context-sensitive. For example, in performance mode if a pre-set (a collection of stored effect parameters) does not have a "wah" effect included, the gestures 146, 147 would have no effect. Additionally, gestures reserved for operating the intelligent pickup will have a variety of contexts in which they will be available and may be considered "global" gestures. For example, gestures such as those depicted in FIGS. 12 and 13, which are used for entering values, may be used anywhere that a numeric value is to be incremented or decremented.

An additional example of a complex gesture might be one which starts as a single swipe of the finger tip; then without lifting the finger, finger tip pressure is increased and decreased expressively. This would result in a series of X and Y coordinates approximating the shape of a single line, along with a series of Z (pressure) values within an expected range of values. Such a gesture might be utilized as a command to expressively increase and decrease the pitch of the sound in the intelligent pickup, simulating the commonly known "wammy bar" on an electric guitar.

In the preferred embodiment, the processor 136 is housed in a protective electronics strip 138 located on one edge 139 of the gesture pad 17. The strip is ideally constructed of a rigid material such as hard plastic, in order to provide protection for sensitive components housed in the strip. The strip 138 also contains electronics 140, including supporting electronics for the processor 136, as well as interface electronics for handling communication between the gesture pad and the intelligent pickup or other equipment. The interface electronics preferably contain the necessary electronics for wired or wireless communications, such as USB, Wi-Fi and Bluetooth.

In a more simplified embodiment, the gesture pad would not contain the simple processor, which would instead be located in the intelligent pickup, or in any other piece of compatible equipment to be controlled by the gesture pad. In such an embodiment, the gesture pad would perform only the basic functions of the sensor, i.e., converting the finger tip touches to electrical signals, and then to XYZ data. The gesture pad would then transmit the XYZ data to the external equipment, and that equipment would then perform the necessary processing to select recognizable gestures and to act upon them. In still another alternative embodiment, processing capability could be located in both the gesture pad and the external equipment, and the processing of the XYZ data could occur in either place selected.

A further option would be to utilize a stand-alone gesture pad, in a situation where the intelligent pickup features were not desired. The gesture pad could be used to provide control of off-board equipment and/or effects, such as smoke, fireworks, and other special effects. Optionally, more than one gesture pad could be utilized in this variation; and could be operated either onboard or off-board by the musician, an engineer, a computer, or any combination thereof.

Figure 20:
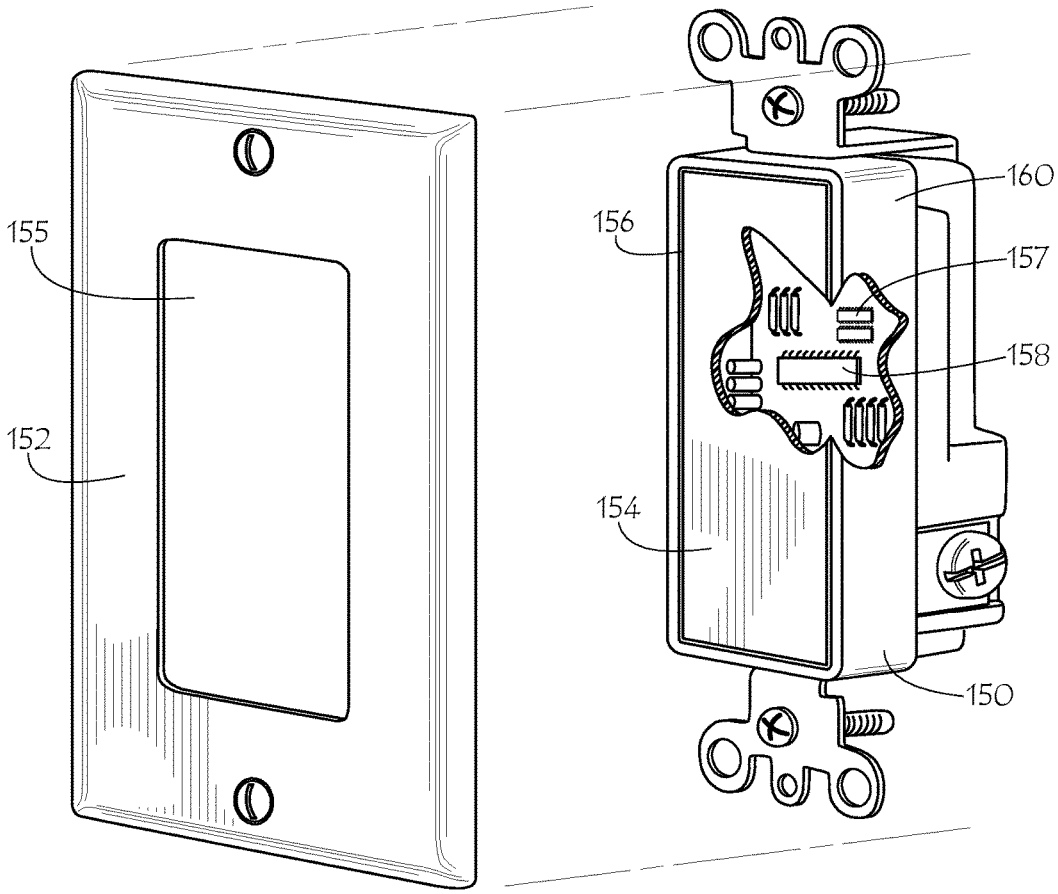
FIG. 20 is a perspective view of a wall-mounted embodiment of the gesture pad for use in home or building automation.

Referring now to FIG. 20, an alternative use for a stand-alone gesture pad 150 is shown. In this use, the gesture pad 150 has been readily adapted for use in home or building automation, and is shown mounted in a wall fixture 152 which is quite similar to a typical wall-mounted light switch. The gesture pad 150 includes the same elements as shown in the musical embodiment of FIGS. 9 and 10, but in a slightly different configuration. The sensor pad 154 is available for XYZ input in the usual fashion, through opening 155 the wall fixture 152. Optional tactile feedback edge 156 may be provided, to aid the user in knowing his location on the pad 154 when making gestures. The usual electronics 157 and processor 158 are provided, within the housing 160. Power may be provided by AC connections 162.

Typically, a communication protocol such as X-10 or KNX which is well-suited for use in home or business automation, or possibly a network protocol such as TCP/IP, would be used in the gesture pad in this application. The gesture pad could provide centralized control of any number of devices in the home or building. For example, it might be used to control lights, heating or air conditioning, security systems, or any other device which could be outfitted with a compatible communication protocol. Not only would the gesture pad provide centralized control, but it could exercise a wide variety of commands. In addition, unlike typical computer interface devices, the gesture pad operates with intuitive gesture commands as input. It may thus be easily operated without looking at the gesture pad itself, which makes it easy to operate in the dark, and makes it particularly well-suited for blind persons. To further enhance its capabilities for operating without visual feedback, the gesture pad could optionally be fitted with a piezoelectric transducer for producing audible feedback to gestures being entered. This could provide feedback to the user that the correct gesture was entered.

Particularly in a home use or building automation application, another simplified embodiment of the gesture pad could be highly useful. In this embodiment, the array of gestures would be stored in the gesture pad in the usual fashion; with each gesture having a respective identifier symbol, such as a number for example, associated with that gesture. When that gesture is entered into the gesture pad, it would be compared to the array of gestures and recognized. Once recognized, the identifier symbol for that gesture would be transmitted to an external processing location, such as a local computer or even a cloud computer, for translation of the associated gesture into a control signal. This would take advantage of the far greater processing power of the computer, to allow translation of the gesture into any one of the multiple communication protocols available to the user. At the same time, the flexibility of the gesture pad is greatly enhanced, without requiring it to have vastly expanded processing capabilities.

This embodiment is particularly suited to home or building automation use for at least two reasons. For one, most homes and other buildings have computers and Internet access, and in many of those location the computers are part of a local network. The gesture pad could thus easily be connected to a local computer, either by wire or wirelessly; and ideally the connection would be over a local network and/or the Internet. Another reason that this embodiment is more suited to home and building automation use is that there would be an inherent latency (delay) involved with transmitting data to a computer, then having the computer issue control signals to target devices. This latency would be small, and acceptable for most home and building automation use, but would not be practical for a music environment.

The above-described embodiments are exemplary only and the following claims are not intended to be limited to these exemplary embodiments. Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

I claim:

1. An integrated transducer-processor unit for use with a stringed instrument having one or more strings, to provide electrical output signals for conversion into musical sounds when the instrument is played, said unit comprising:

a transducer for converting mechanical vibrations of each of said strings into corresponding electrical signals;

a processor for processing said electrical signals from said transducer to produce selected analog or digital output signals wherein said processor is integrated with said transducer into a pickup for mounting on said instrument in proximity to the strings;

communication electronics for sending said output signals off-board from said unit; and, a user interface for controlling said processor to alter said output signals, said user interface further utilizing said communication electronics to send and receive signals off-board to and from said unit.

2. An integrated transducer-processor unit as claimed in claim 1, wherein said processor is capable of generating control signals from said electrical signals produced by said transducer, said control signals being capable of being used to further direct the processing of said electrical signals in order to produce selected musical effects in said output signals, or to control an external device, or both.

3. An integrated transducer-processor unit as claimed in claim 1, wherein said pickup is configured to be mounted underneath the strings.

4. An integrated transducer-processor unit as claimed in claim 3, wherein said processor is capable of generating control signals from said electrical signals produced by said transducer, said control signals being capable of being used to further direct the processing of said electrical signals in order to produce selected musical effects in said output signals, or to control an external device, or both.

5. An integrated transducer-processor unit as claimed in claim 4, wherein:

said musical effects are selected from the group consisting of pitch, volume, and tone.

6. An integrated transducer-processor unit as claimed in claim 1, wherein:

said instrument has at least one existing receptacle for receiving a pickup; and said transducer and said processor are housed in a single mechanical housing, said housing having form characteristics compatible with said existing receptacle so as to be installable in said receptacle.

7. An integrated transducer-processor unit as claimed in claim 6, wherein said processor is capable of generating control signals from said electrical signals produced by said transducer, said control signals being capable of being used to further direct the processing of said electrical signals in order to produce selected musical effects in said output signals, or to control an external device, or both.

8. An integrated transducer-processor unit as claimed in claim 7, wherein:

said musical effects are selected from the group consisting of pitch, volume, and tone.

9. An intelligent pickup system for use by a user with a stringed instrument having one or more strings, to provide electrical output signals for conversion into musical sounds when the instrument is played, said system comprising:

a transducer for converting mechanical vibrations of each of said strings into corresponding electrical signals;

a first processor for processing said electrical signals to produce selected analog or digital output signals, wherein said processor is integrated with said transducer into a pickup for mounting on said instrument in proximity to the strings of the instrument; and a user interface device utilizing communication electronics for sending control signals to said first processor to selectively alter said output signals to produce desired musical sounds; and wherein said user interface further utilizes said communication electronics to send and receive signals off-board to and from said pickup.

10. An intelligent pickup system as claimed in claim 9, wherein:

said interface device includes a touch pad for receiving positional and pressure inputs entered by making a manual gesture on the surface of the pad; wherein:

said touch pad has a transducer for converting said gesture inputs into electrical signals constituting a data set defining said manual gesture, said data set consisting of x and y values representing position and z values representing pressure; and wherein:

said user interface device further includes a second processor having an array of stored data sets representing potential gestures, each of said data sets having a control signal associated therewith, so that when a manual gesture is entered into the pad and converted to an x,y,z data set, said second processor compares said entered x, y, and z data to the array of stored data sets, and if a stored data set is found in said array which matches said entered x, y, z data, said second processor sends the control signal associated with said matching stored data set to said first processor to control said first processor.

11. An intelligent pickup system as claimed in claim 10, wherein feedback is provided to the user from touching the touch pad and from the music produced, without the use of a graphical user interface, to enable the user to determine the extent to which said music has been produced as desired.

12. An intelligent pickup system as claimed in claim 10, wherein:

said manual gesture includes said finger touching at least two points on said touch pad.

13. An intelligent pickup system as claimed in claim 10, wherein:

said manual gesture includes movement of said finger between at least two points on said touch pad.

14. An intelligent pickup system as claimed in claim 10, wherein:

said second processor is programmable, so that the stored data sets within said array or the control signal associated with any stored data set, or both, may be selectively altered.

15. An intelligent pickup system as claimed in claim 9, wherein said interface device includes a force transducer for converting mechanical force exerted by the user into electrical control signals for controlling said unit.

16. An intelligent pickup system as claimed in claim 15, wherein said interface device includes a strap button having the force transducer, and a strap connected to said button through which the user exerts said mechanical force on said button.

17. An intelligent pickup system as claimed in claim 9, wherein:

said instrument has at least one existing receptacle for receiving a pickup; and wherein said transducer and said processor are housed in a single mechanical housing, said housing having form characteristics compatible with said existing receptacle so that said housing is installable in said receptacle.

18. A method for use with a stringed instrument to produce selected musical effects when the instrument is played, comprising the steps of:

providing an integrated transducer processor unit including:

a transducer for converting mechanical vibrations of each of said strings into corresponding electrical signals;

a processor for processing said electrical signals from said transducer to produce selected analog or digital output signals wherein said processor is integrated with said transducer into a pickup for mounting on said instrument in proximity to the strings;

communication electronics for sending said output signals off-board from said unit; and, a user interface for controlling said processor to alter said output signals, said user interface further utilizing said communication electronics to send and receive signals off-board to and from said unit;

playing said instrument to produce said selected output signals; and sending said output signals off-board from said unit for conversion into desired musical sounds.

19. A method for producing selected musical effects as claimed in claim 18, wherein:

said processor is capable of generating control signals from said electrical signals produced by said transducer, said control signals being capable of being used to further direct the processing of said electrical signals in order to produce selected musical effects in said output signals, or to control an external device, or both.

20. A method for producing selected musical effects as claimed in claim 19, wherein said musical effects are selected from the group consisting of pitch, volume, and tone.

* * * * *